US011493041B2

(12) United States Patent
Yamada

(10) Patent No.: US 11,493,041 B2
(45) Date of Patent: Nov. 8, 2022

(54) SCROLL COMPRESSOR

(71) Applicant: DAIKIN INDUSTRIES, LTD., Osaka (JP)

(72) Inventor: Masahiro Yamada, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/578,209

(22) Filed: Jan. 18, 2022

(65) Prior Publication Data

US 2022/0136503 A1 May 5, 2022

Related U.S. Application Data

(63) Continuation of application No. PCT/JP2020/029890, filed on Aug. 4, 2020.

(30) Foreign Application Priority Data

Aug. 5, 2019 (JP) ..... JP2019-143730

(51) Int. Cl.
*F04C 18/02* (2006.01)
*F04C 29/12* (2006.01)
(Continued)

(52) U.S. Cl.
CPC ..... *F04C 18/0223* (2013.01); *F04C 29/02* (2013.01); *F04C 2240/30* (2013.01); *F04C 2240/60* (2013.01)

(58) Field of Classification Search
CPC ..... F04C 18/0223; F04C 18/0246; F04C 18/0215; F04C 29/02; F04C 18/02; F04C 29/12; F01C 1/0253; F01C 1/0261
See application file for complete search history.

(56) References Cited

U.S. PATENT DOCUMENTS 4,744,737 A 5/1988 Yamamura et al.
5,567,137 A 10/1996 Nakashima et al.
(Continued)

FOREIGN PATENT DOCUMENTS

CN 87 1 03954 A 12/1987
JP 61-197786 A 9/1986
(Continued)

OTHER PUBLICATIONS

International Preliminary Report of corresponding PCT Application No. PCT/JP2020/029890 dated Feb. 17, 2022.
(Continued)

*Primary Examiner* — Deming Wan
(74) *Attorney, Agent, or Firm* — Global IP Counselors, LLP

(57) ABSTRACT

A hermetic scroll compressor has a symmetric wrap structure. The scroll compressor includes fixed and movable scrolls, a crank shaft, a motor, and a casing. The casing includes an oil reservoir, and a motor space serving as a low-pressure space. The fixed and movable scrolls define first and second compression chambers. The fixed scroll has a first passage to guide gas refrigerant in the low-pressure space to the first and second compression chambers. The movable scroll has a second passage to guide gas refrigerant in the low-pressure space to the first compression chamber. The gas refrigerant that has passed through the first and second passages flows into the first compression chamber. The gas refrigerant that has passed through the first passage also flows into the second compression chamber.

11 Claims, 21 Drawing Sheets

(51) Int. Cl.
*F01C 1/02* (2006.01)
*F04C 29/02* (2006.01)

(56) References Cited

U.S. PATENT DOCUMENTS

| | | | | |
|---|---|---|---|---|
| 9,803,643 | B2 * | 10/2017 | Ohno | F04C 28/20 |
| 2016/0032924 | A1 * | 2/2016 | Stover | F04C 28/26 418/55.5 |
| 2020/0300245 | A1 * | 9/2020 | Park | F04C 18/0215 |
| 2020/0332795 | A1 * | 10/2020 | Kato | F04C 29/0007 |

FOREIGN PATENT DOCUMENTS

| | | | |
|---|---|---|---|
| JP | 7-167069 | A | 7/1995 |
| JP | 11-82336 | A | 3/1999 |
| JP | 2013-227873 | A | 11/2013 |
| JP | 58-44402 | U | 12/2016 |
| JP | 2018-9537 | A | 1/2018 |

OTHER PUBLICATIONS

International Search Report of corresponding PCT Application No. PCT/JP2020/029890 dated Oct. 6, 2020.
European Search Report of corresponding EP Application No. 20 85 0952.1 dated Jul. 14, 2022.

* cited by examiner

SCROLL COMPRESSOR

CROSS-REFERENCE TO RELATED APPLICATIONS

This is a continuation of International Application No. PCT/JP2020/029890 filed on Aug. 4, 2020, which claims priority to Japanese Patent Application No. 2019-143730, filed on Aug. 5, 2019. The entire disclosures of these applications are incorporated by reference herein.

BACKGROUND

Field of Invention

Embodiments disclosed herein relate to a scroll compressor.

Background Information

JP 2018-009537 A discloses a scroll compressor that is of a low-pressure shell type and has a symmetric wrap structure. This compressor includes two scrolls. The scrolls include spiral bodies (wraps) having symmetrical spiral shapes. When the compressor sucks in a gas refrigerant for compressing the gas refrigerant, part of the gas refrigerant flows into a first suction chamber defined by the two scrolls, through a first refrigerant guide port connected to a suction pipe, while the remaining gas refrigerant flows into a second suction chamber defined by the two scrolls, through a second refrigerant guide port connected to the suction pipe. The first refrigerant guide port and the second refrigerant guide port are disposed opposite each other with a rotation axis in between. The refrigerant guide ports are bored in a frame fixing a fixed scroll of the two scrolls to a hermetic container (a casing).

SUMMARY

A first aspect provides a scroll compressor having a symmetric wrap structure and being fully hermetic. The scroll compressor includes fixed and movable scrolls, a crank shaft configured to rotate about a rotation axis to drive the movable scroll, a motor configured to rotate the crank shaft, and a casing having an internal space defined to accommodate the fixed scroll, the movable scroll, the crank shaft, and the motor. The fixed scroll includes a fixed-side flat plate and a fixed-side wrap having a spiral shape and extending from a front face of the fixed-side flat plate. The movable scroll includes a movable-side flat plate and a movable-side wrap having a spiral shape and extending from a front face of the movable-side flat plate. The casing includes an oil reservoir configured to retain a refrigerating machine oil, the oil reservoir being located on a bottom of the internal space, and a motor space configured to accommodate the motor, the motor space serving as a low-pressure space into which a low-pressure gas refrigerant is sucked externally. The fixed scroll and the movable scroll define a first compression chamber surrounded by the front face of the fixed-side flat plate, the front face of the movable-side flat plate, an inner peripheral face of the fixed-side wrap, and an outer peripheral face of the movable-side wrap. The fixed scroll and the movable scroll define a second compression chamber surrounded by the front face of the fixed-side flat plate, the front face of the movable-side flat plate, an outer peripheral face of the fixed-side wrap, and an inner peripheral face of the movable-side wrap. The fixed scroll and the movable scroll are disposed in an upper part of the internal space in the casing. The fixed scroll has a first passage configured to guide the gas refrigerant in the low-pressure space to the first compression chamber and the second compression chamber. The movable scroll has a second passage configured to guide the gas refrigerant in the low-pressure space to the first compression chamber. The gas refrigerant that has passed through the first passage and the gas refrigerant that has passed through the second passage flows into the first compression chamber. The gas refrigerant that has passed through the first passage also flows into the second compression chamber.

DETAILED DESCRIPTION OF EMBODIMENT(S)

Figure 1:
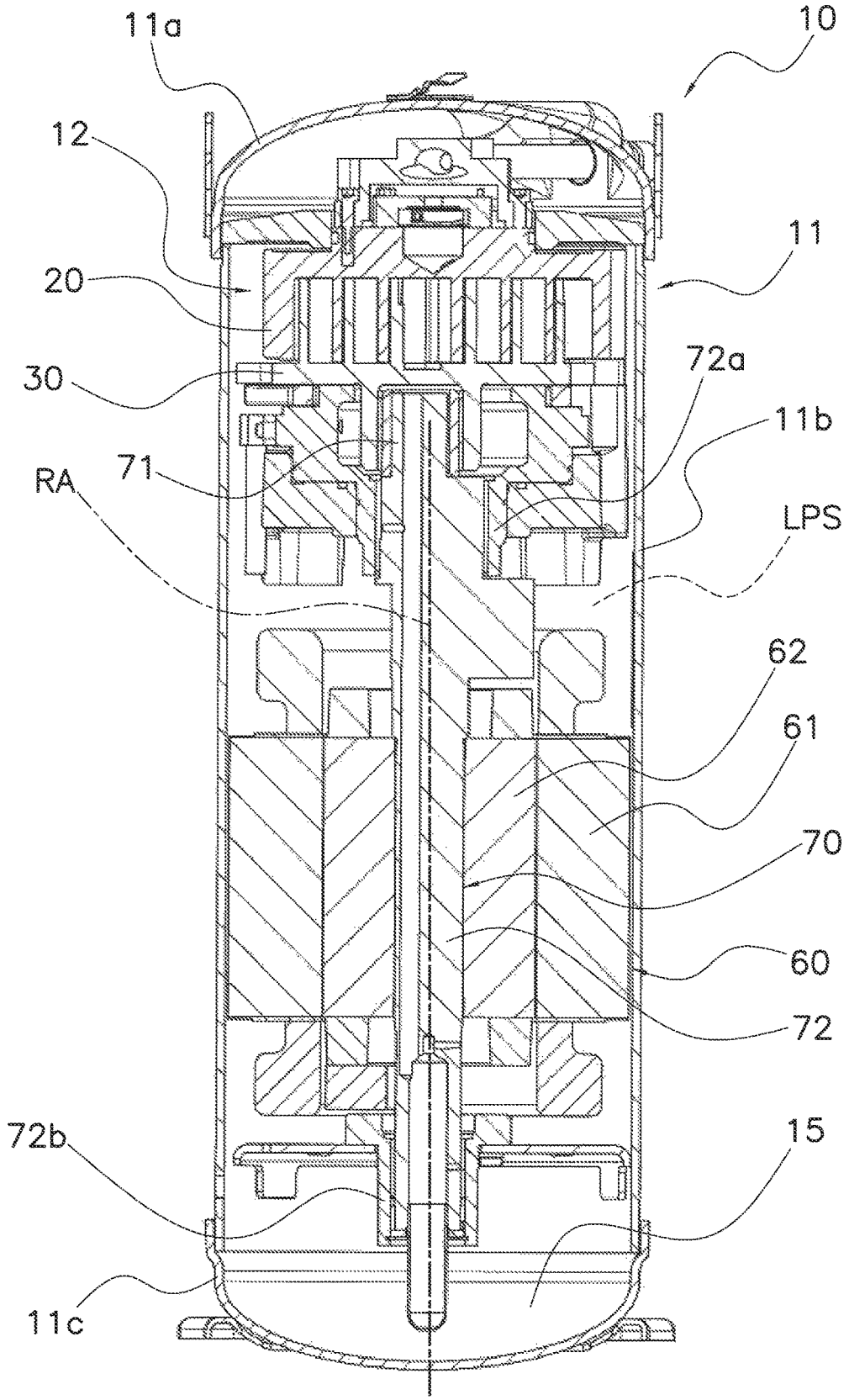
FIG. 1 is a longitudinal sectional view of a scroll compressor.

FIG. 1 is a longitudinal sectional view of a scroll compressor 10. In the following description, the use of expressions "upper", "lower", and the like indicating directions and arrangement in the scroll compressor 10 is based on FIG. 1 unless otherwise specified.

(1) General Configuration

The scroll compressor 10 is configured to compress a refrigerant in a refrigeration apparatus in implementing a refrigeration cycle for circulating the refrigerant. The scroll compressor 10 is installed in, for example, an outdoor unit of an air conditioning apparatus. The scroll compressor 10 serves as a part of a refrigerant circuit in the air conditioning apparatus. The scroll compressor 10 is configured to suck, compress, and discharge a refrigerant. A non-limiting example of the refrigerant is a hydrofluorocarbon (HFC) refrigerant such as R32. It should be noted that R32 is merely an example and a refrigerant to be compressed by the scroll compressor 10 is not limited to R32.

The scroll compressor 10 is of a fully hermetic type. In addition, the scroll compressor 10 has a symmetric wrap structure.

As illustrated in FIG. 1, the scroll compressor 10 mainly includes a casing 11, a compression mechanism 12, a motor 60, and a crank shaft 70.

(2) Specific Configuration (2-1) Casing

With reference to FIG. 1, the scroll compressor 10 includes the casing 11 having a vertically elongated cylindrical shape.

The casing 11 includes a cylindrical member 11*b* having upper and lower open ends, an upper cover 11*a* disposed on the upper open end of the cylindrical member 11*b*, and a lower cover 11*c* disposed on the lower open end of the cylindrical member 11*b*. The cylindrical member 11*b*, the upper cover 11*a*, and the lower cover 11*c* are fixed by welding so that a hermetic state is kept in the casing 11.

The casing 11 accommodates the constituent components (e.g., the compression mechanism 12, the motor 60, the crank shaft 70) of the scroll compressor 10.

In the casing 11, the compression mechanism 12 is disposed on an upper side of an internal space. The compression mechanism 12 includes a fixed scroll 20 (to be described later) fixed to the casing 11. The motor 60 is disposed below the compression mechanism 12. The casing 11 has an oil reservoir 15 on the bottom of the internal space. The oil reservoir 15 stores a refrigerating machine oil for lubricating a sliding portion of the compression mechanism 12 and a sliding portion of the crank shaft 70.

In the casing 11, the internal space is a low-pressure space LPS into which a low-pressure gas refrigerant is sucked externally, except the upper side where the compression mechanism 12 is disposed. In other words, the low-pressure space LPS is a space into which the refrigerant flows from the refrigerant circuit, which includes the scroll compressor 10, of the air conditioning apparatus. The scroll compressor 10 is of a low-pressure shell type (also referred to as a low-pressure dome type).

A suction pipe (not illustrated) is connected to the cylindrical member 11*b* of the casing 11. A discharge pipe is connected to the upper cover 11*a* of the casing 11, and the compressed gas refrigerant is discharged from the casing 11 through the discharge pipe.

(2-2) Motor

The motor 60 is configured to drive a movable scroll 30 (to be described later) of the compression mechanism 12. As illustrated in FIG. 1, the motor 60 includes a stator 61 having a ring shape, and a rotor 62.

The stator 61 is fixed to an inner face of the cylindrical member 11*b* of the casing 11. The stator 61 has a coil wound therearound.

The rotor 62 has a cylindrical shape. The rotor 62 is accommodated in the stator 61 having the ring shape, with a slight gap (an air gap) between the rotor 62 and the stator 61 such that the rotor 62 is rotatable. The rotor 62 has a hollow portion into which the crank shaft 70 is inserted. The rotor 62 is coupled to the movable scroll 30 via the crank shaft 70. The rotor 62 rotates in accordance with startup of the motor 60 to transmit a force to the movable scroll 30 coupled thereto via the crank shaft 70. The movable scroll 30 thus swirls.

(2-3) Crank Shaft

The crank shaft 70 extends up and down in the casing 11. The crank shaft 70 couples the rotor 62 of the motor 60 to the movable scroll 30 (to be described later) of the compression mechanism 12. The crank shaft 70 transmits a driving force of the motor 60 to the movable scroll 30.

As illustrated in FIG. 1, the crank shaft 70 mainly includes an eccentric portion 71 and a main shaft 72. The eccentric portion 71 is disposed on an upper end of the main shaft 72. The eccentric portion 71 has a center axis that is eccentric relative to a center axis of the main shaft 72. The center axis of the main shaft 72 corresponds to a rotation axis RA of the crank shaft 70. The eccentric portion 71 is inserted in a bearing metal in a boss portion 33 (see FIG. 3B) of the movable scroll 30. The center axis of the eccentric portion 71 passes the center of the movable scroll 30 with the eccentric portion 71 inserted in the boss portion 33 and the movable scroll 30 coupled to the crank shaft 70.

The main shaft 72 is supported by an upper bearing 72*a* and a lower bearing 72*b* in a rotatable manner. The main shaft 72 between the upper bearing 72*a* and the lower bearing 72*b* is inserted through and coupled to the rotor 62 of the motor 60.

The crank shaft 70 has therein an oil passage (not illustrated). The refrigerating machine oil in the oil reservoir 15 is pumped up by a pump disposed on a lower end of the crank shaft 70. The refrigerating machine oil thus pumped up is then supplied to a sliding portion of each component in the casing 11.

(2-4) Compression Mechanism

The compression mechanism 12 mainly includes the fixed scroll 20, the movable scroll 30, and an Oldham coupling. As illustrated in, for example, FIGS. 4B and 4E, the movable scroll 30 and the fixed scroll 20 define, in combination, a first compression chamber A and a second compression chamber B.

The compression mechanism 12 compresses the refrigerant in the first compression chamber A and the second compression chamber B, and discharges the refrigerant thus compressed.

The compression mechanism 12 has a symmetric wrap structure. As illustrated in, for example, FIG. 4E, in the symmetric wrap structure of the compression mechanism 12, the first compression chamber A and the second compression chamber B are defined in a point symmetric state. The first compression chamber A is surrounded with and defined by an outer peripheral face 32*a* of a movable-side wrap 32 of the movable scroll 30 (to be described later) and an inner peripheral face 22*b* of a fixed-side wrap 22 of the fixed scroll 20 (to be described later), as seen in plan view. The second compression chamber B is surrounded with and defined by an inner peripheral face 32*b* of the movable-side wrap 32 and an outer peripheral face 22*a* of the fixed-side wrap 22, as seen in plan view. According to the symmetric wrap structure of the compression mechanism 12, refrigerant compression in the first compression chamber A and refrigerant compression in the second compression chamber B are started concurrently. According to the symmetric wrap structure of the compression mechanism 12, the movable-side wrap 32 is identical in winding end angle to the fixed-side wrap 22.

The Oldham coupling is disposed below the movable scroll 30. The Oldham coupling is configured to restrict rotation of the movable scroll 30, thereby causing the movable scroll 30 to revolve with respect to the fixed scroll 20.

Next, a specific description will be given of the fixed scroll 20 and the movable scroll 30.

(2-4-1) Fixed Scroll

Figure 6A:
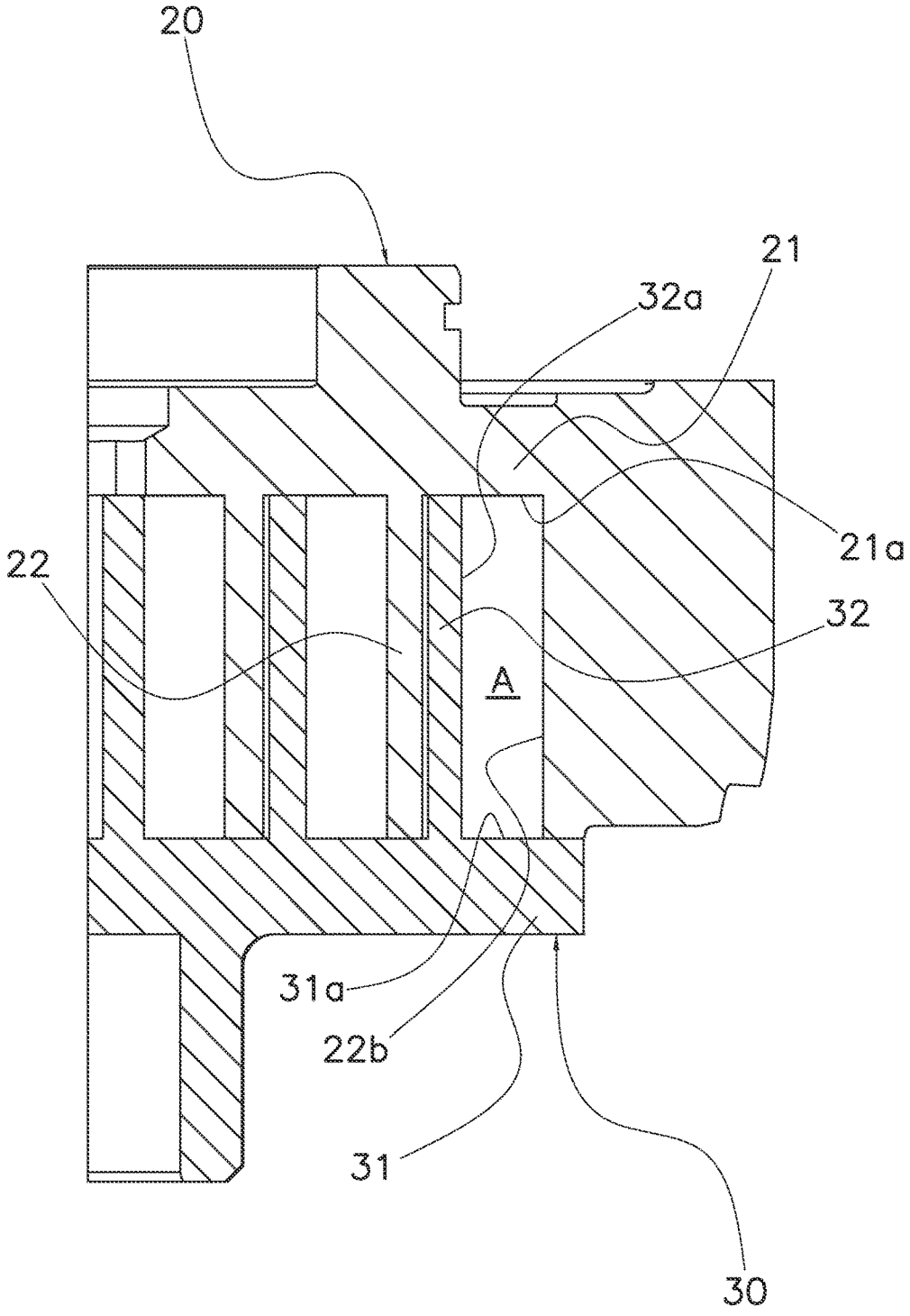
FIG. 6A is a longitudinal sectional view of the first compression chamber A at a position near the winding end portion of the fixed-side wrap.
Figure 6B:
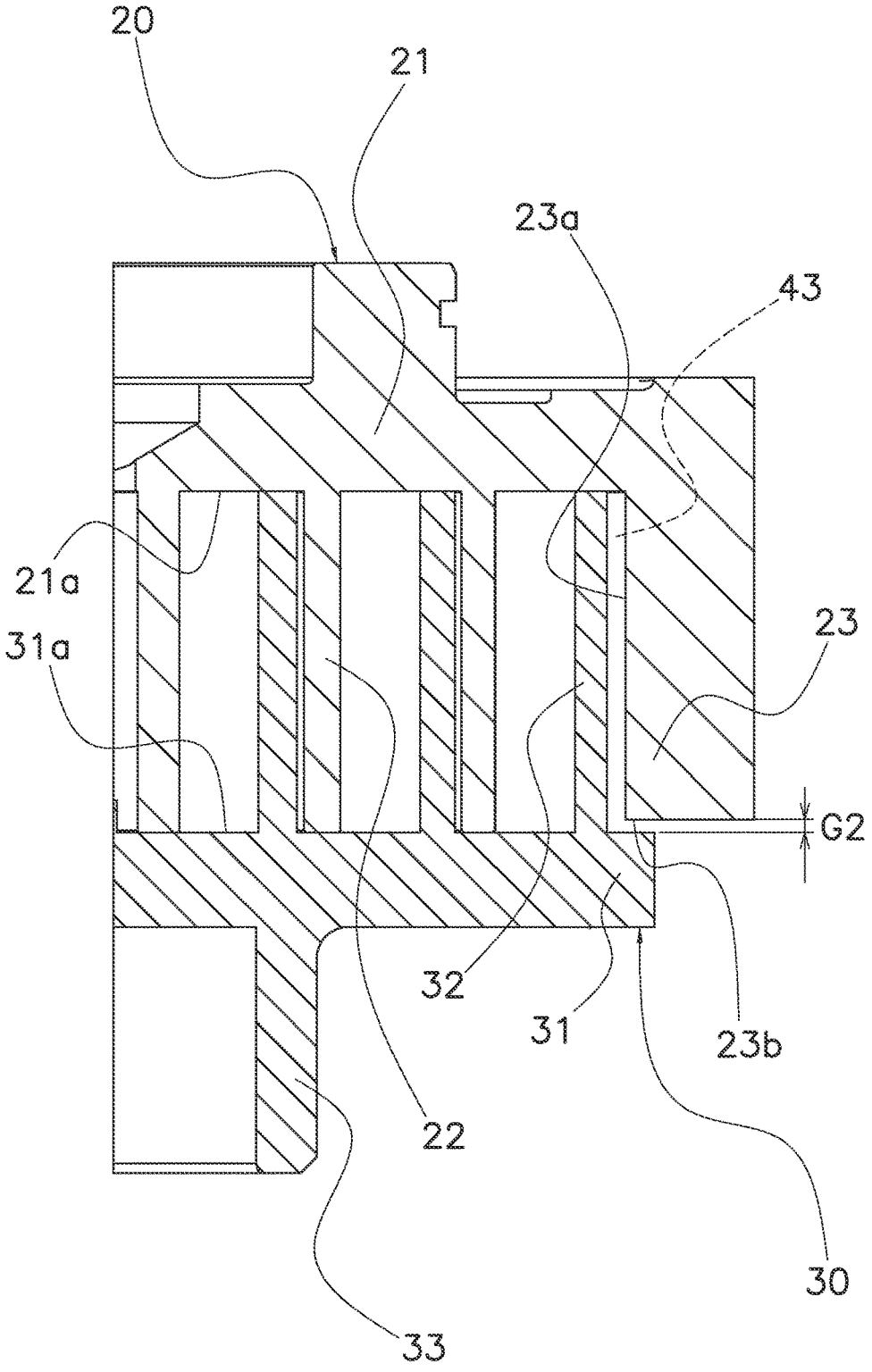
FIG. 6B is a longitudinal sectional view of the third passage 43 and a second gap G2 for guiding a refrigerant to the first compression chamber A, at a certain cutting position.

As illustrated in FIGS. 2A to 2G as well as FIGS. 6A and 6B, the fixed scroll 20 includes a fixed-side flat plate 21 having a disk shape and the fixed-side wrap 22.

Figure 2A:
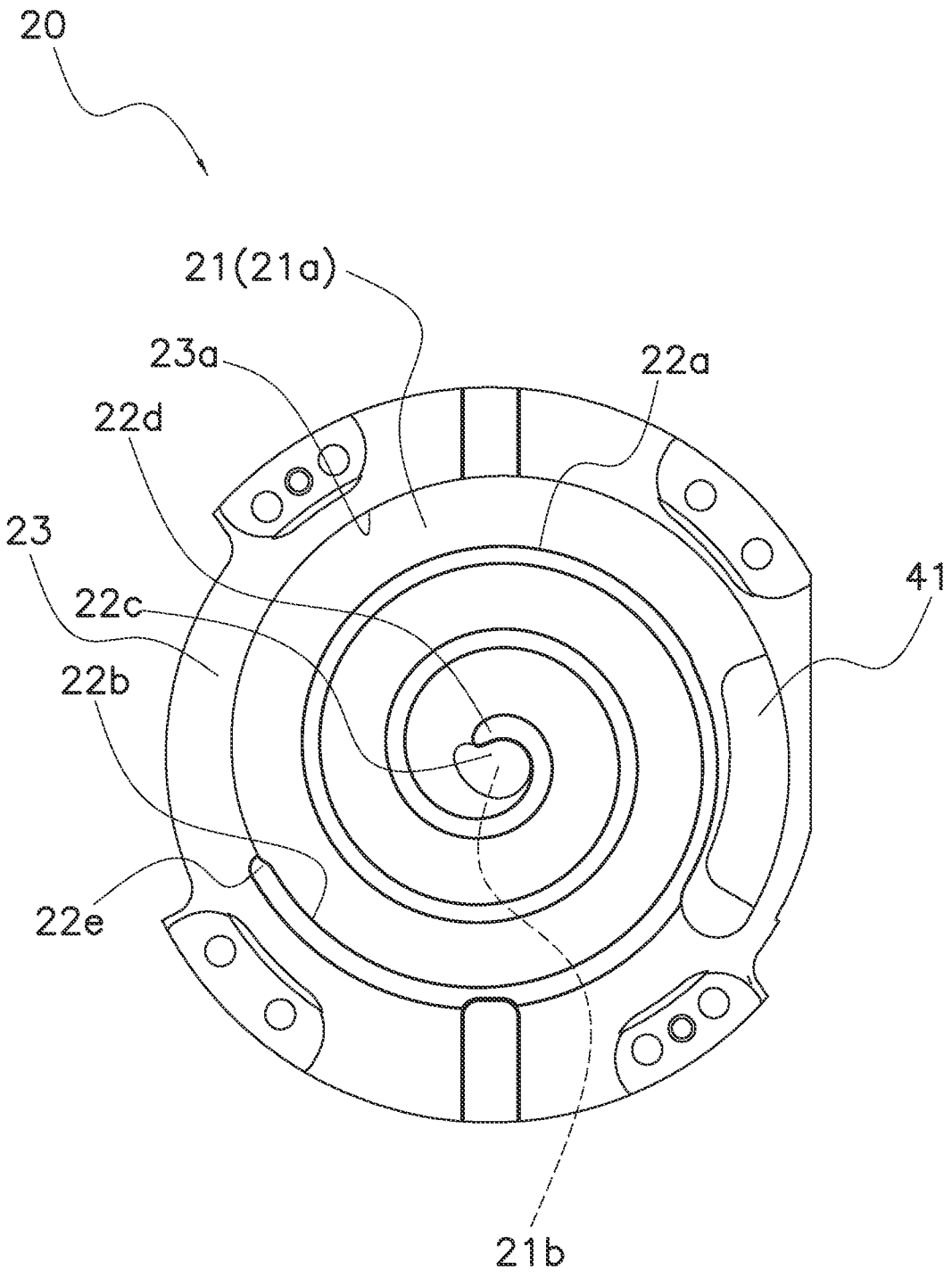
FIG. 2A is a bottom view of a fixed scroll.
Figure 2B:
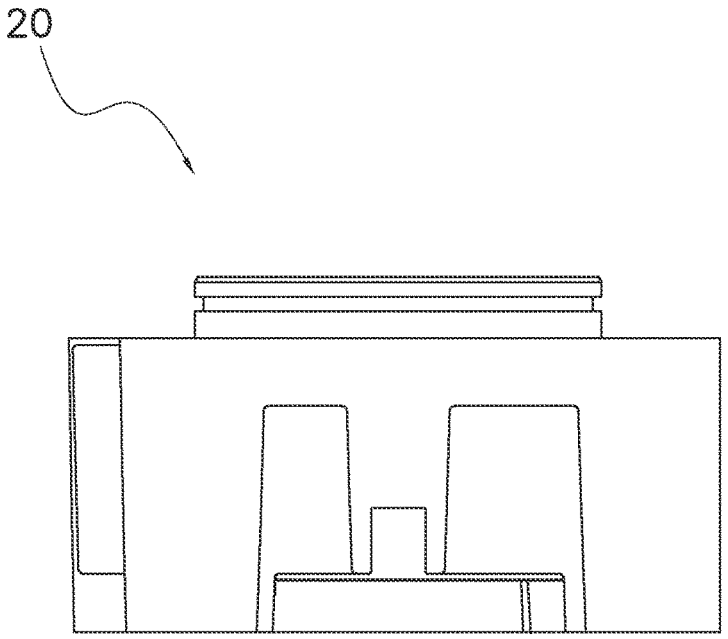
FIG. 2B is a front view of the fixed scroll.
Figure 2C:
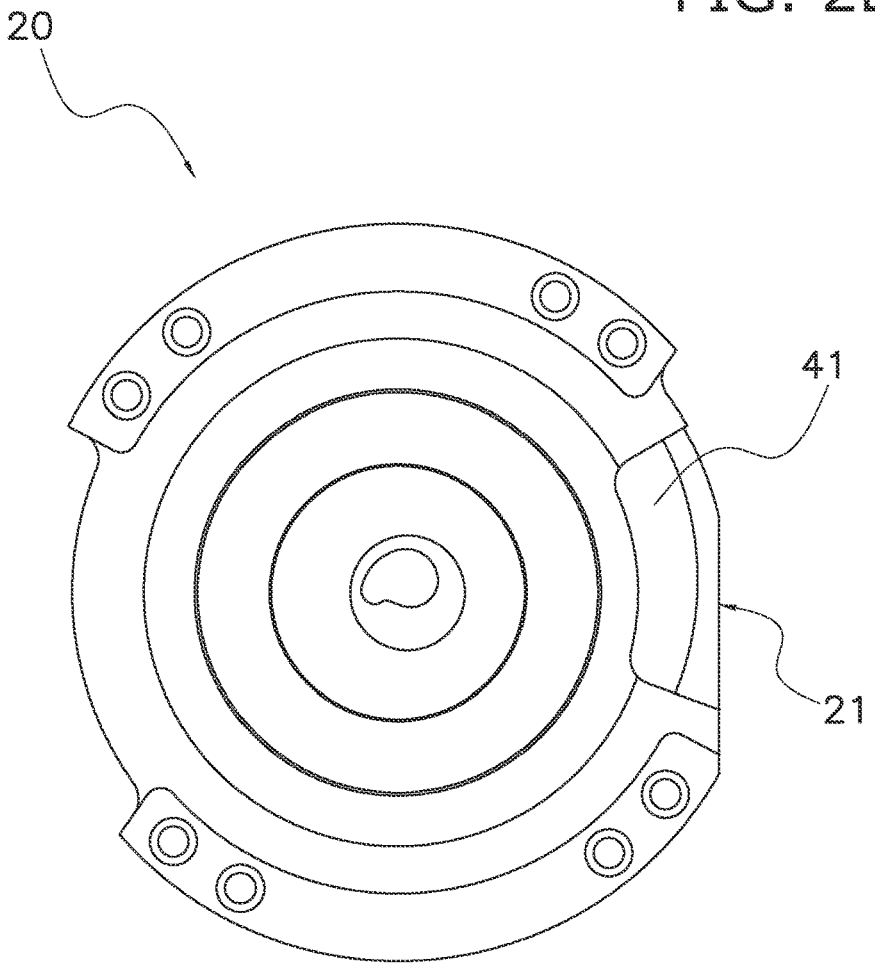
FIG. 2C is a top view of the fixed scroll.
Figure 2D:
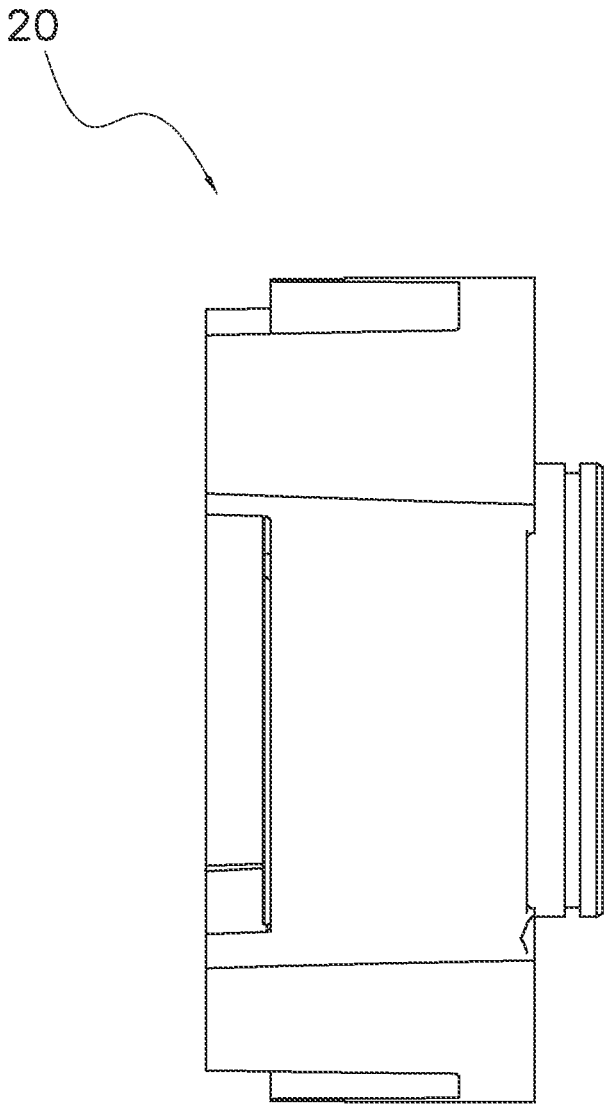
FIG. 2D is a left side view of the fixed scroll.
Figure 2E:
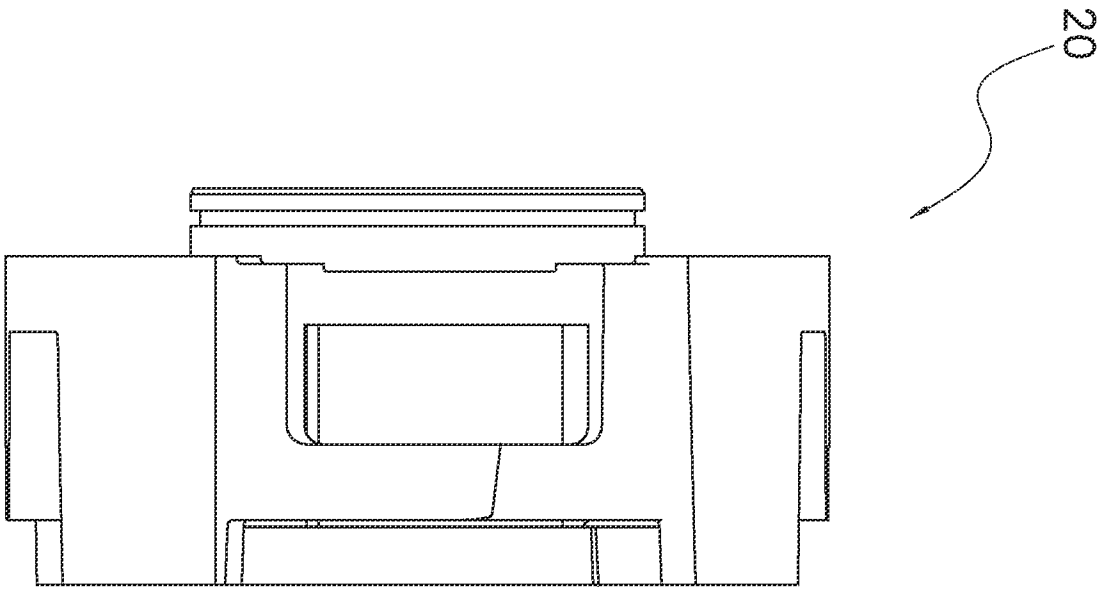
FIG. 2E is a right side view of the fixed scroll.
Figure 2F:
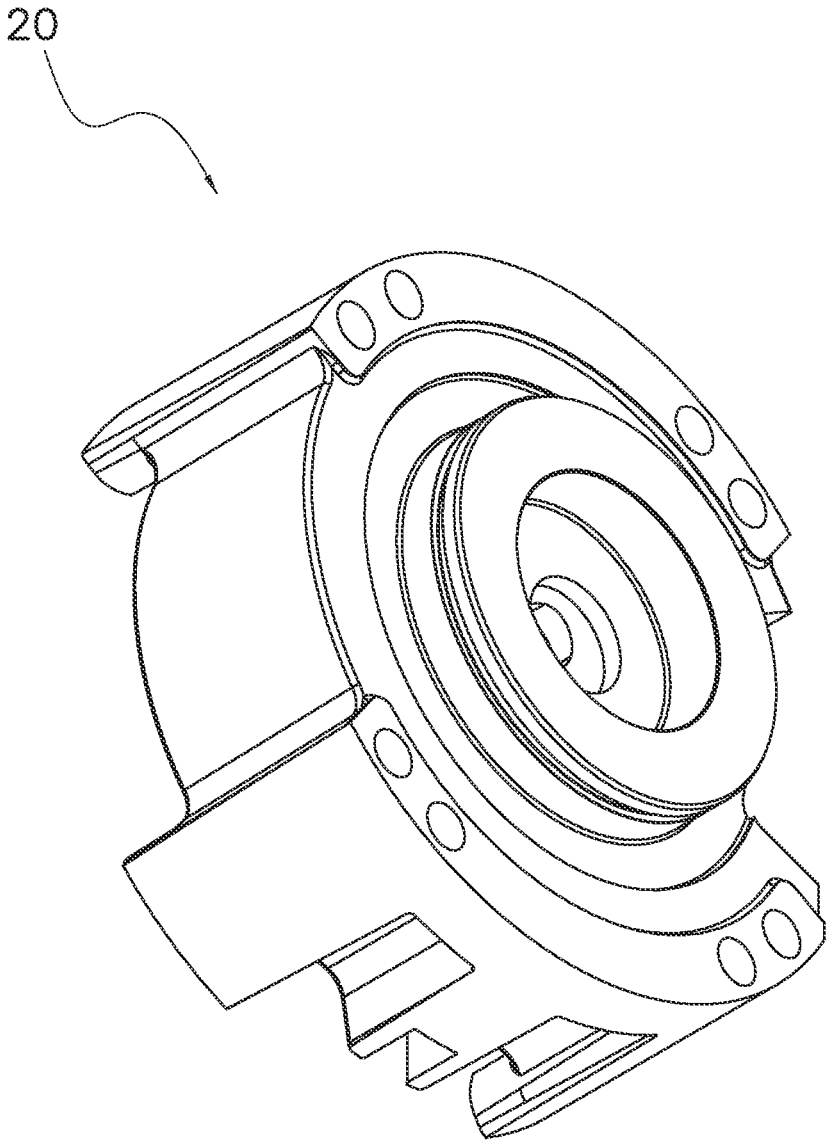
FIG. 2F is a perspective view of the fixed scroll seen from its upper left side.

As illustrated in FIG. 6A, the fixed-side wrap 22 extends downward from a front face 21*a* of the fixed-side flat plate 21 along the rotation axis RA. As illustrated in FIG. 2A, the fixed-side wrap 22 has a spiral shape as seen in plan view, and this spiral shape extends from a winding start portion 22*d* near a center of the fixed scroll 20 to a winding end portion 22*e* on an outer periphery of the fixed scroll 20. The fixed-side wrap 22 has a spiral shape drawn with, for example, an involute curve. The inner peripheral face 22*b* of the fixed-side wrap 22 continuously extends from the winding start portion 22*d* of the fixed-side wrap 22 to the winding end portion 22*e* of the fixed-side wrap 22. The winding start portion 22*d* of the fixed-side wrap 22 is located closer to the center 22*c* of the fixed-side wrap 22. The winding end portion 22*e* of the fixed-side wrap 22 is located farther from the center 22*c* of the fixed-side wrap 22. The fixed-side wrap 22 is combined with the movable-side wrap 32 of the movable scroll 30 (to be described later) to define the first and second compression chambers A and B. As illustrated in FIG. 4E, specifically, the fixed scroll 20 and the movable scroll 30 are combined with each other with the front face 21*a* of the fixed-side flat plate 21 disposed opposite a front face 31*a* of the movable-side flat plate 31, to thereby define the first and second compression chambers A and B surrounded with the fixed-side flat plate 21, the fixed-side wrap 22, the movable-side wrap 32, and the movable-side flat plate 31 of the movable scroll 30 to be described later. When the movable scroll 30 swirls with respect to the fixed scroll 20, the refrigerant, which has flowed into the first and second compression chambers A and B from the low-pressure space LPS illustrated in FIG. 1, is compressed as the refrigerant approaches the center of the fixed scroll 20 in the first and second compression chambers A and B. The pressure of the refrigerant is thus increased.

As illustrated in FIG. 2A, the fixed-side flat plate 21 has, in its substantial center, a discharge port 21*b* through which the refrigerant compressed by the compression mechanism 12 is discharged. The discharge port 21*b* extends through the fixed-side flat plate 21 in a thickness direction (an up-and-down direction). The discharge port 21*b* communicates with the first and second compression chambers A and B at the center of the compression mechanism 12. The compression mechanism 12 also includes a discharge valve disposed above the fixed-side flat plate 21 and configured to open and close the discharge port 21*b*. When the pressure in each of the first and second compression chambers A and B, with which the discharge port 21*b* communicates, becomes higher than the internal pressure in the discharge pipe by a predetermined value or more, the discharge valve is opened so that the refrigerant flows toward the discharge pipe through the discharge port 21*b*.

Figure 2G:
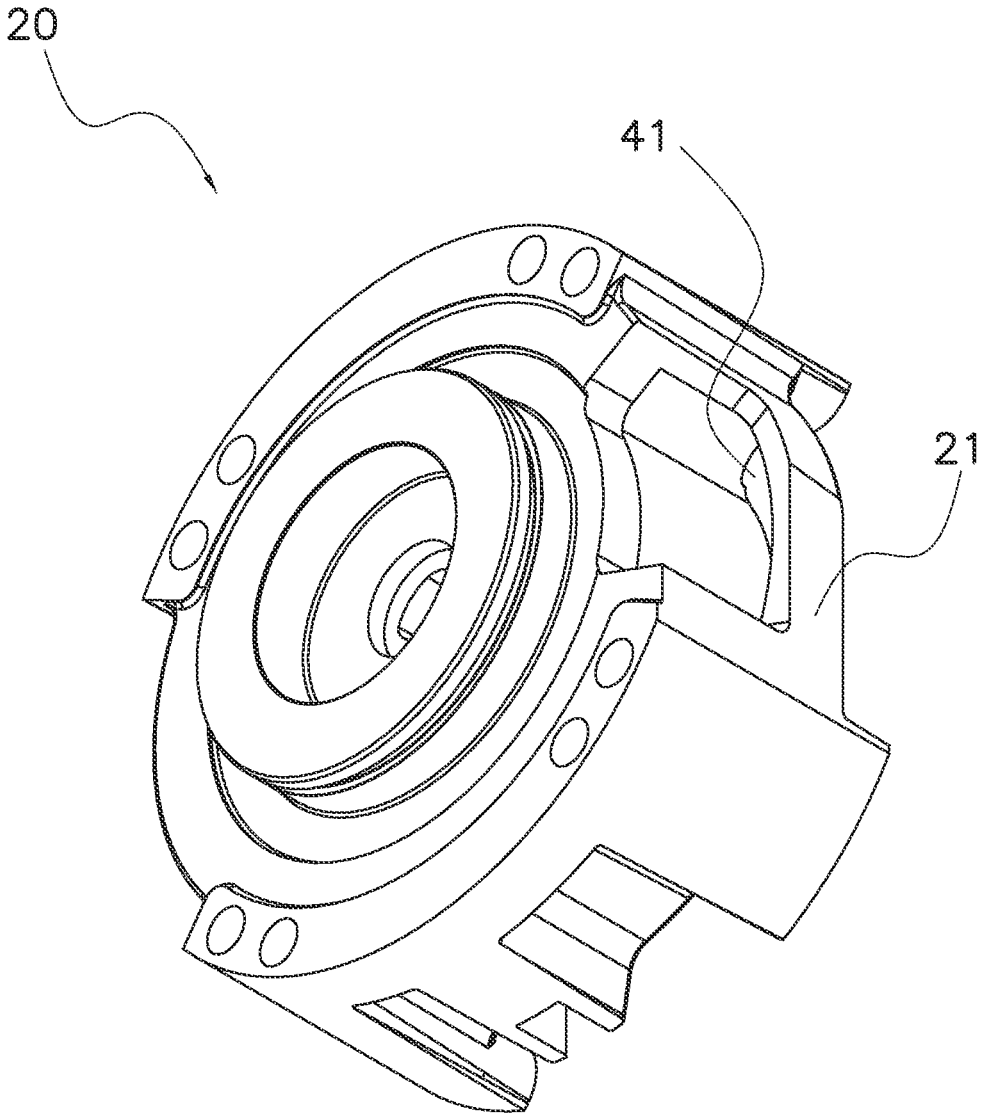
FIG. 2G is a perspective view of the fixed scroll seen from its upper right side.

The fixed scroll 20 has a first passage 41 for guiding the refrigerant in the low-pressure space LPS, to the first and second compression chambers A and B. As illustrated in FIGS. 2A and 2G, the first passage 41 is a hole (an opening) bored in the fixed-side flat plate 21.

The fixed scroll 20 also has on its outer periphery a wall 23 that does not define the first and second compression chambers. The wall 23 has an inner face 23*a* that is contiguous with the inner peripheral face 22*b* of the winding end portion 22*e* of the fixed-side wrap 22. As illustrated in, for example, FIG. 4B, the inner face 23*a* is opposite the outer peripheral face 32*a*, which does not define the first and second compression chambers, of the movable-side wrap 32 of the movable scroll 30.

(2-4-2) Movable Scroll

As illustrated in, for example, FIGS. 3A to 3G as well as FIGS. 6A and 6B, the movable scroll 30 mainly includes the movable-side flat plate 31, the movable-side wrap 32, and the boss portion 33 extending downward from a rear face (a lower face) of the movable-side flat plate 31. A chip seal may be provided between a blade end (an upper end) of the movable-side wrap 32 and the front face 21*a* of the fixed-side flat plate 21.

The movable-side flat plate 31 has the front face (the upper face) 31*a* that is opposite the front face 21*a* of the fixed-side flat plate 21. As illustrated in FIG. 6A, the movable-side wrap 32 extends upward from the front face 31*a* of the movable-side flat plate 31 along the rotation axis RA. The movable-side wrap 32 has a spiral shape as seen in plan view, and this spiral shape extends from a winding start portion 32*d* near a center 32*c* of the movable scroll 30 to a winding end portion 32*e* on an outer periphery of the movable scroll 30. The movable-side wrap 32 has a spiral shape drawn with, for example, an involute curve.

In this embodiment, the center 32*c* of the movable scroll 30 corresponds to the center of a base circle drawn with an involute curve defining the shape of the movable-side wrap 32. The center 32*c* of the movable scroll 30 also corresponds to a point through which the center axis of the eccentric portion 71 of the crank shaft 70 inserted in the boss portion 33 passes.

The outer peripheral face 32*a* of the movable-side wrap 32 continuously extends from the winding start portion 32*d* of the movable-side wrap 32 to the winding end portion 32*e* of the movable-side wrap 32. The winding start portion 32*d* of the movable-side wrap 32 is located closer to the center 32*c* of the movable-side wrap 32. The winding end portion 32*e* of the movable-side wrap 32 is located farther from the center 32*c* of the movable-side wrap 32.

Figure 3A:
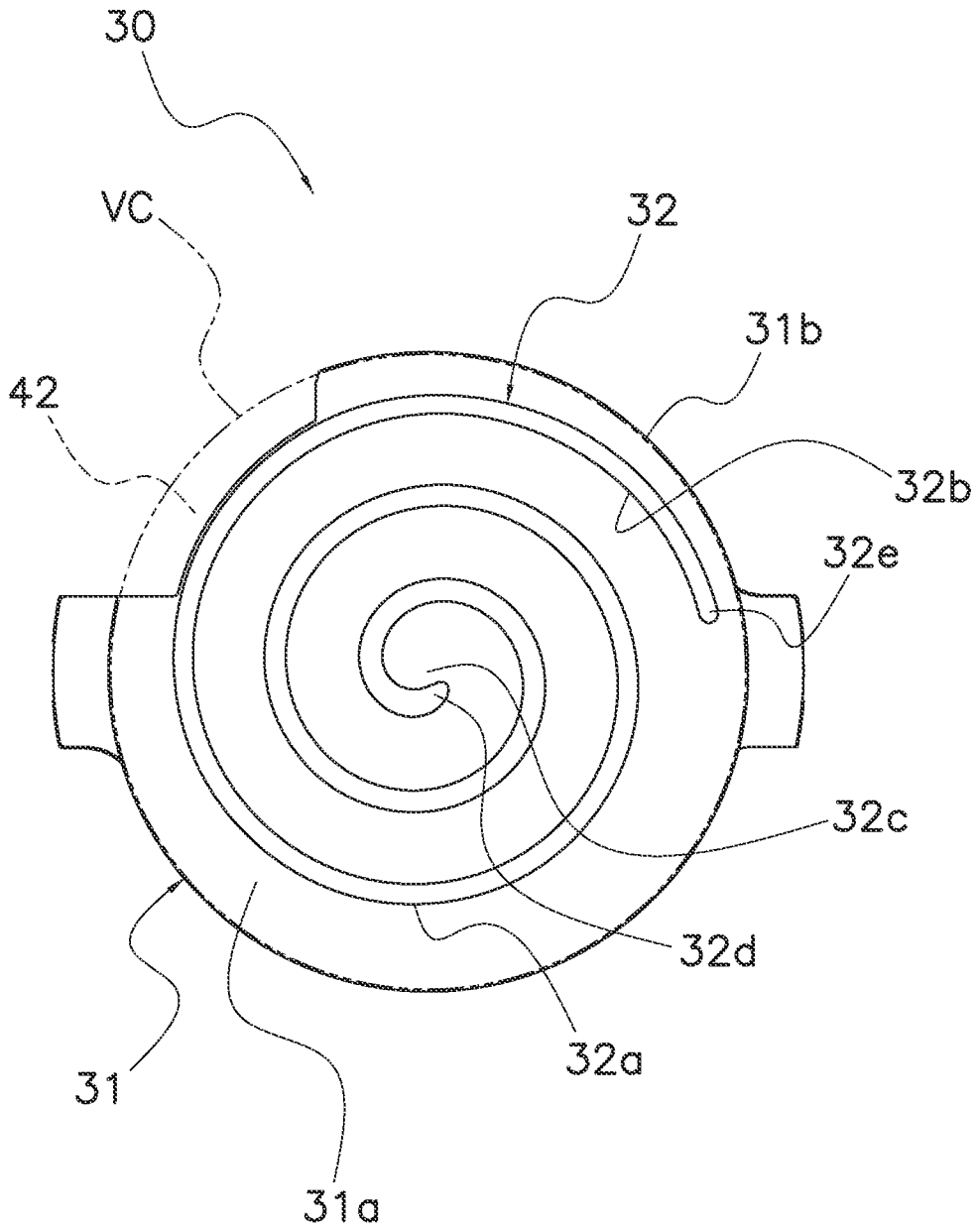
FIG. 3A is a top view of a movable scroll.
Figure 3B:
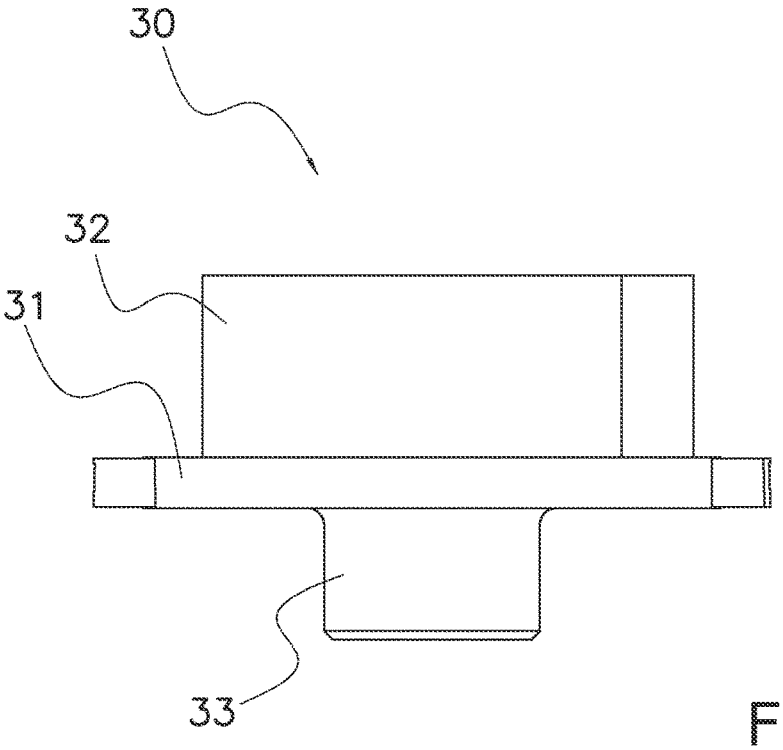
FIG. 3B is a front view of the movable scroll.
Figure 3C:
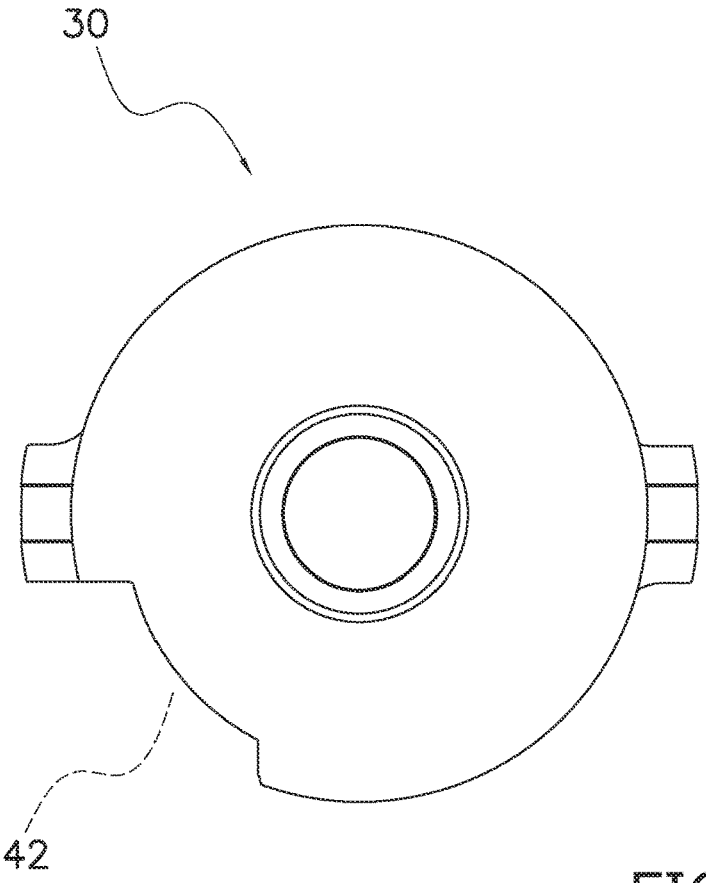
FIG. 3C is a bottom view of the movable scroll.
Figure 3D:
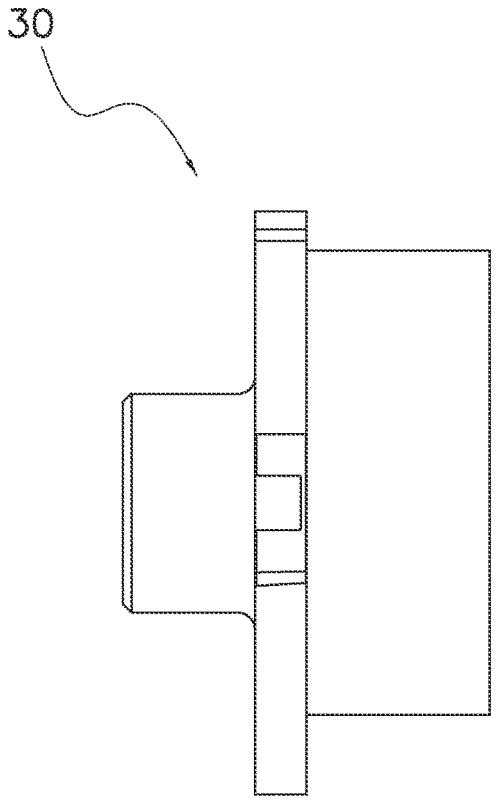
FIG. 3D is a left side view of the movable scroll.
Figure 3E:
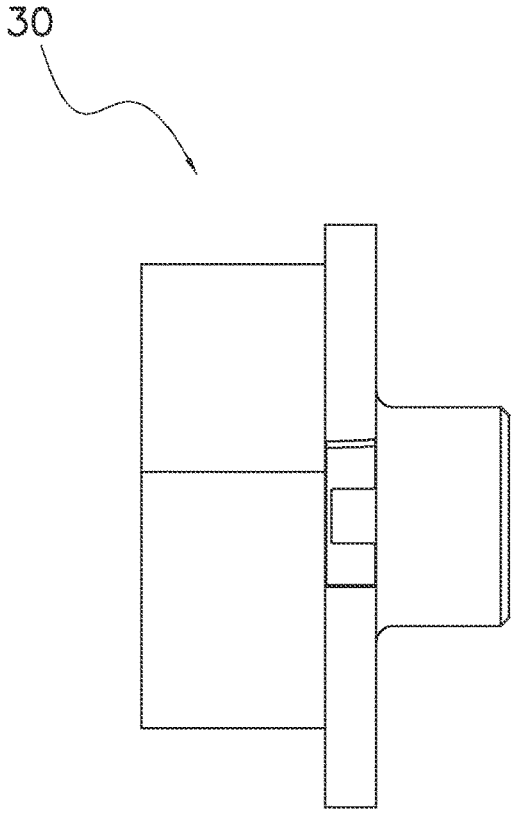
FIG. 3E is a right side view of the movable scroll.
Figure 3F:
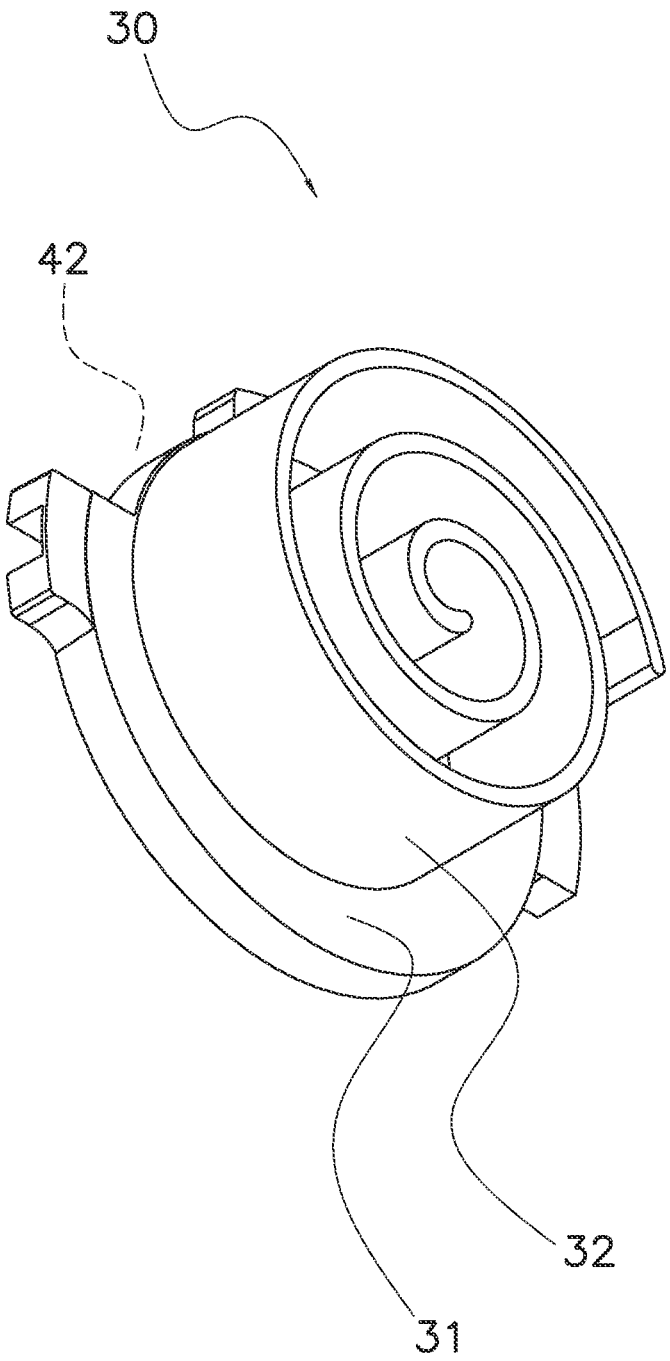
FIG. 3F is a perspective view of the movable scroll seen from its upper left side.
Figure 3G:
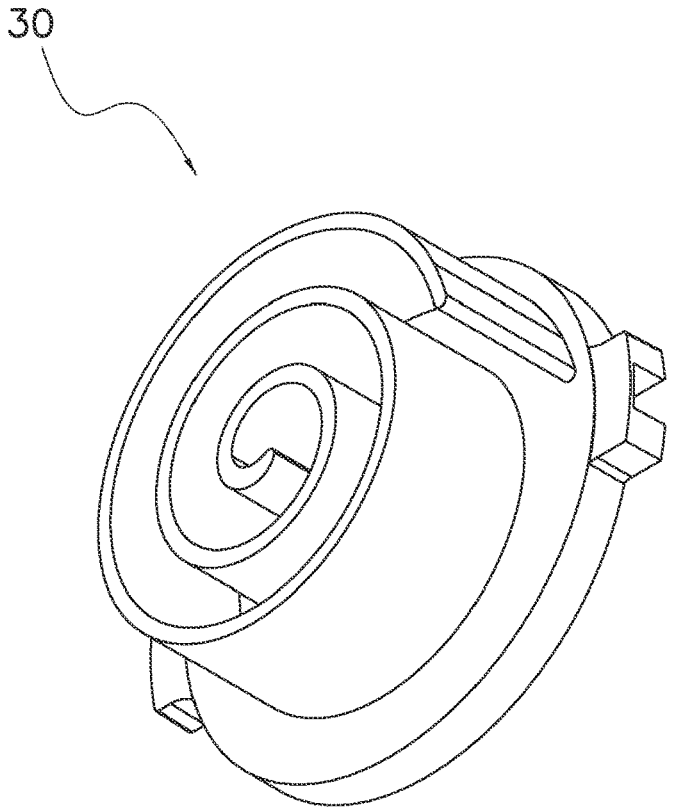
FIG. 3G is a perspective view of the movable scroll seen from its upper right side.

As illustrated in FIG. 3A, in the movable scroll 30, the movable-side flat plate 31 has an outer edge 31*b* that is substantially coincident with a virtual circle VC as seen in the direction of the rotation axis RA. The virtual circle VC is a circle in virtual plan view, and the outer edge 31*b* of the movable-side flat plate 31 is coincident with the virtual circle VC by 50% or more.

As illustrated in FIG. 3A, the movable scroll 30 has a cutout serving as a second passage 42 to be described later. The cutout serving as the second passage 42 extends inward with respect to the virtual circle VC. The second passage 42 is therefore inevitably located inside the virtual circle VC.

(2-4-3) Combination of Fixed Scroll with Movable Scroll

Figure 4A:
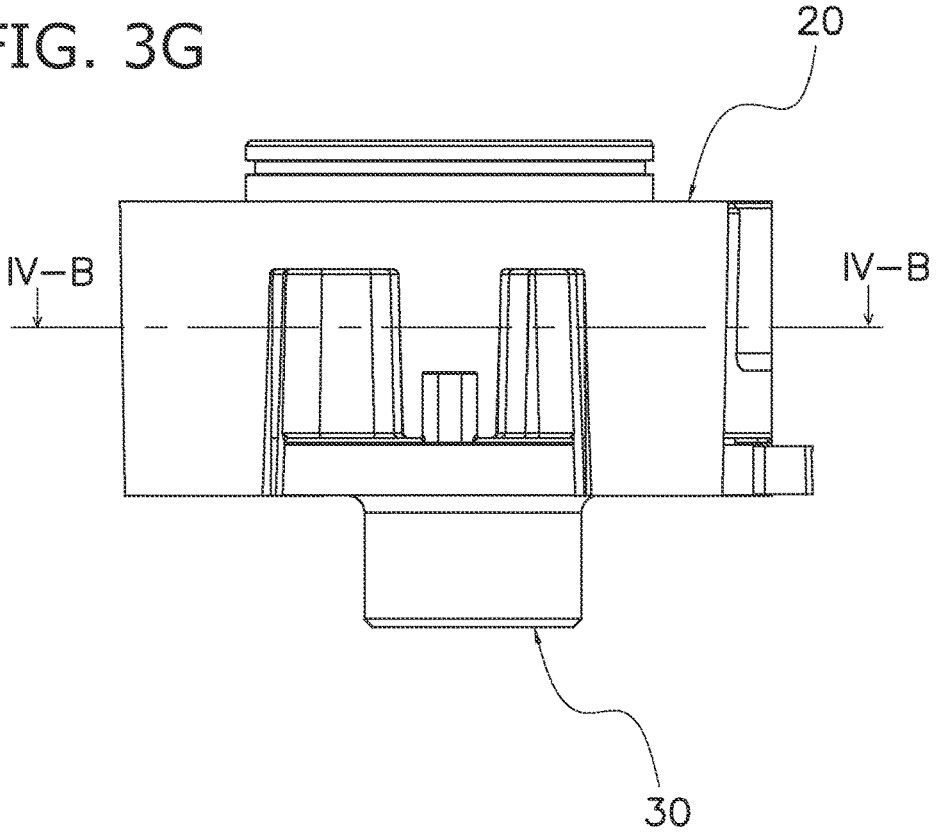
FIG. 4A is a front view of the fixed scroll and the movable scroll with their wraps engaged with each other.
Figure 4B:
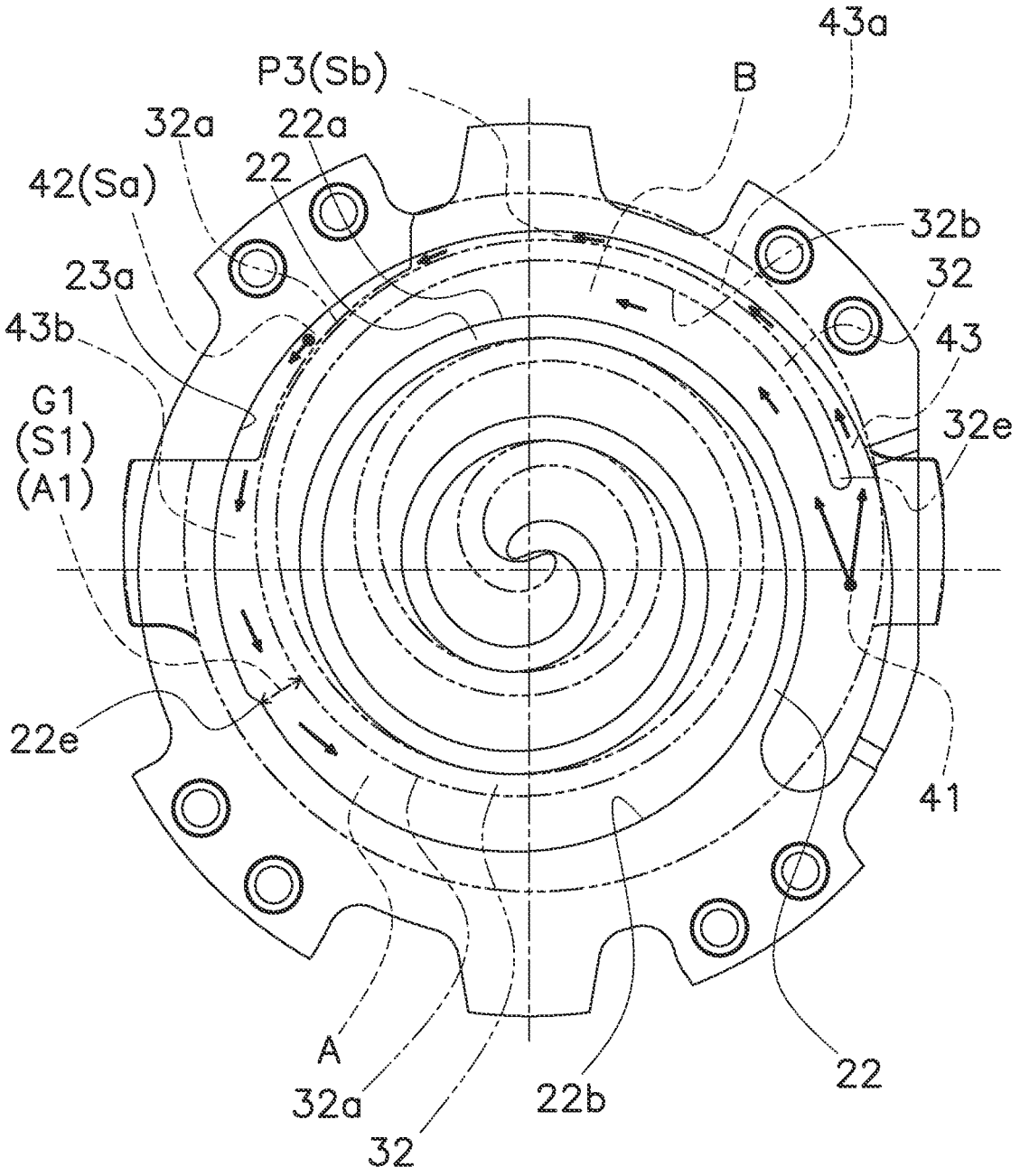
FIG. 4B is a plan view of the fixed scroll and the movable scroll at a height position IV-B in FIG. 4A, illustrating compression chambers and refrigerant guide passages defined by the fixed scroll and the movable scroll at a certain timing.
Figure 4C:
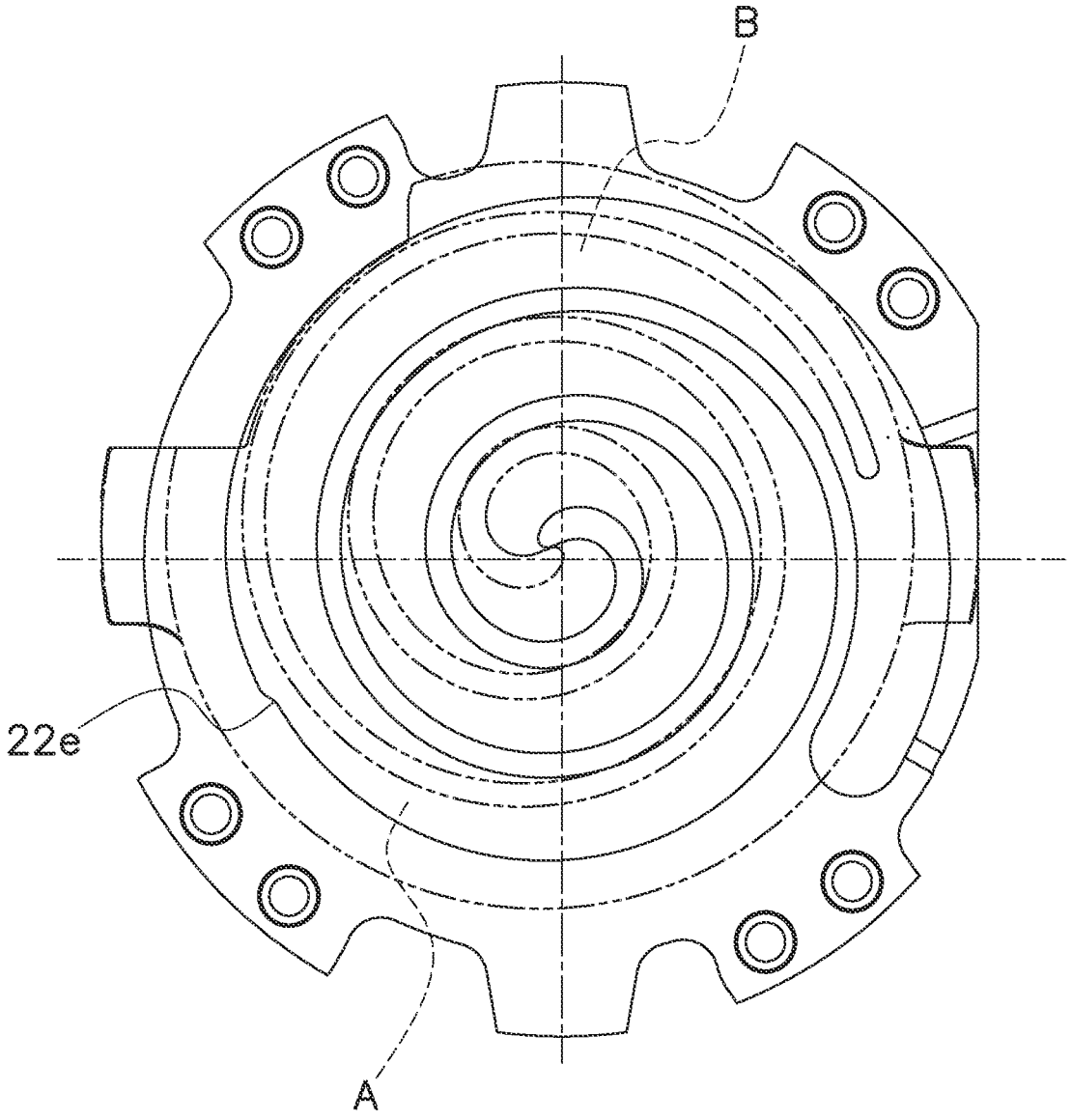
FIG. 4C is a plan view of the fixed scroll and the movable scroll at the height position IV-B in FIG. 4A, illustrating the compression chambers and the refrigerant guide passages defined by the fixed scroll and the movable scroll at another timing.
Figure 4D:
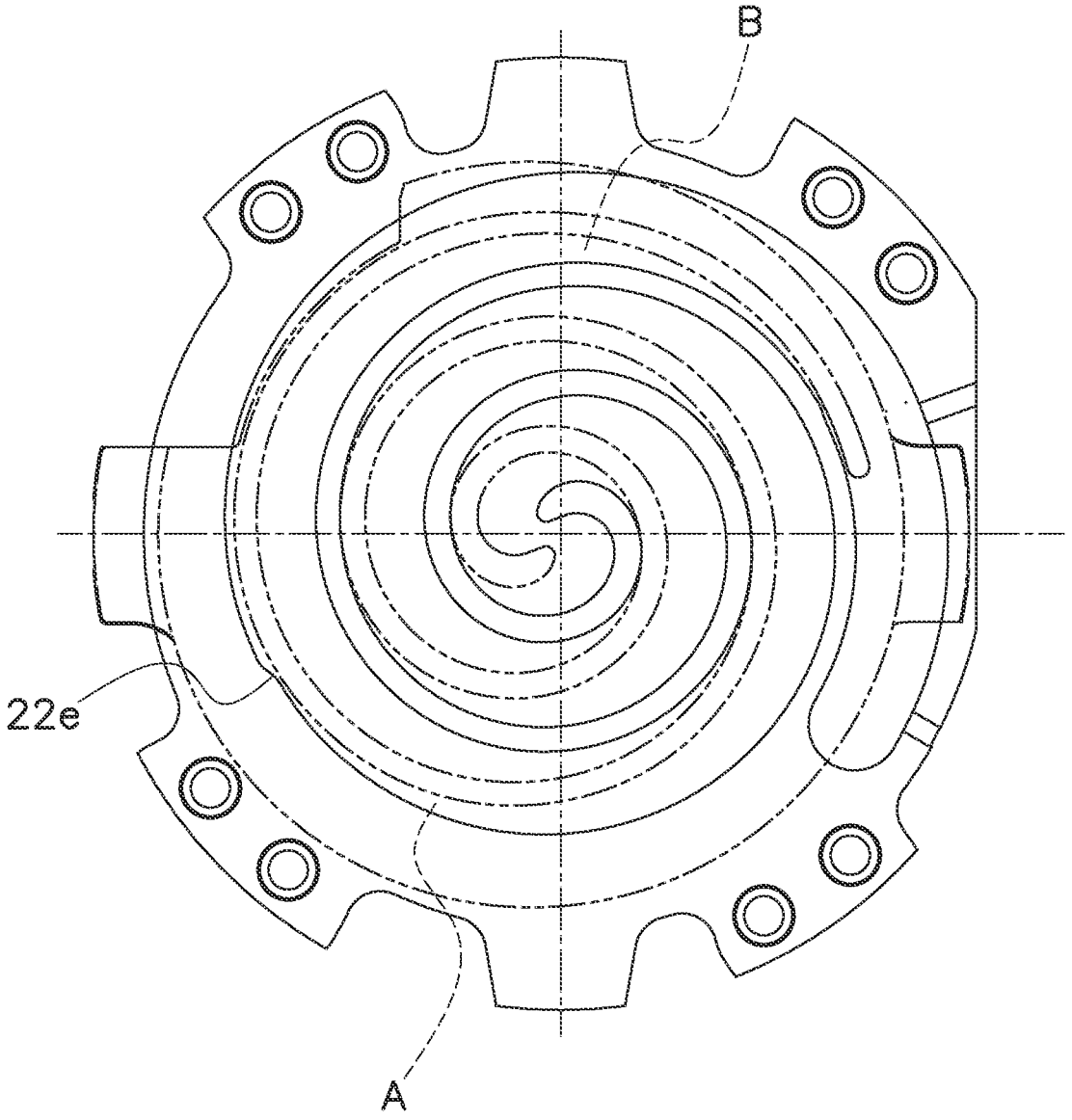
FIG. 4D is a plan view of the fixed scroll and the movable scroll at the height position IV-B in FIG. 4A, illustrating the compression chambers and the refrigerant guide passages defined by the fixed scroll and the movable scroll at still another timing.
Figure 4E:
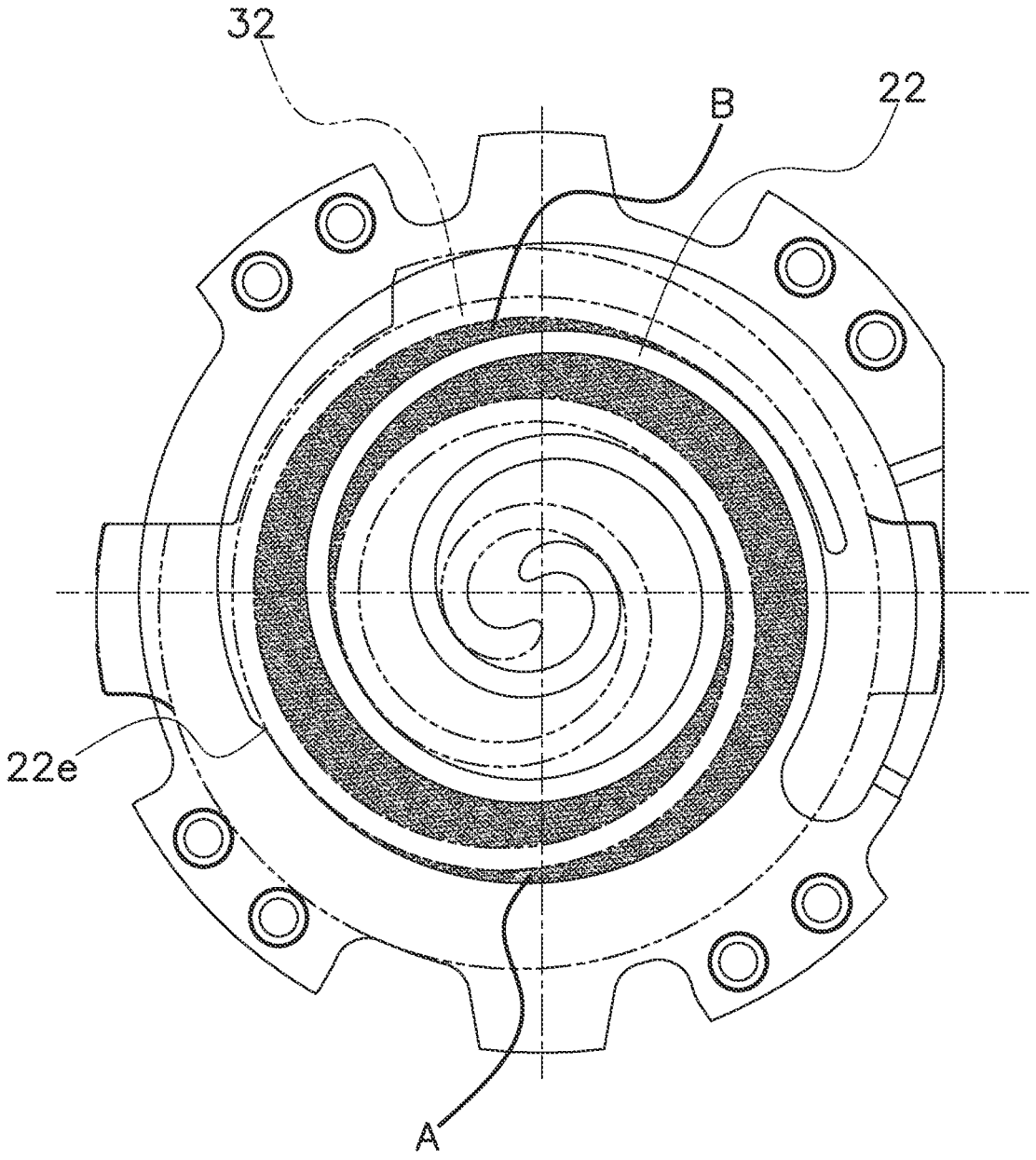
FIG. 4E is a plan view of the compression chambers hatched for emphasis, immediately after the compression chambers are closed by winding end portions of the wraps.

FIGS. 4A and 4B each illustrate the fixed scroll 20 and the movable scroll 30 that are combined with each other. FIG. 4A is a front view of the fixed scroll 20 and the movable scroll 30 with the fixed-side wrap 22 engaged with the movable-side wrap 32. FIG. 4B is a plan view of the fixed scroll 20 and the movable scroll 30 at a height position IV-B in FIG. 4A, illustrating the first and second compression chambers A and B and the refrigerant guide passages (i.e., the first passage 41 and the second passage 42) defined by the fixed scroll 20 and the movable scroll 30 at a certain timing. In FIGS. 4A to 4E as well as FIGS. 5A to 5C, a solid line indicates the fixed scroll 20 and a chain double-dashed line indicates the movable scroll 30 for ease of the distinction between the fixed scroll 20 and the movable scroll 30. In FIG. 4A and FIGS. 5A to 5C, a bold arrow indicates a flow of the gas refrigerant into the first and second compression chambers A and B, for ease of the understanding.

Of the first and second compression chambers A and B, the first compression chamber A is defined by the front face 21*a* of the fixed-side flat plate 21, the front face 31*a* of the movable-side flat plate 31, the inner peripheral face 22*b* of the fixed-side wrap 22, and the outer peripheral face 32*a* of the movable-side wrap 32. Of the first and second compression chambers A and B, the second compression chamber B is defined by the front face 21*a* of the fixed-side flat plate 21, the front face 31*a* of the movable-side flat plate 31, the outer peripheral face 22*a* of the fixed-side wrap 22, and the inner peripheral face 32*b* of the movable-side wrap 32.

Figure 5A:
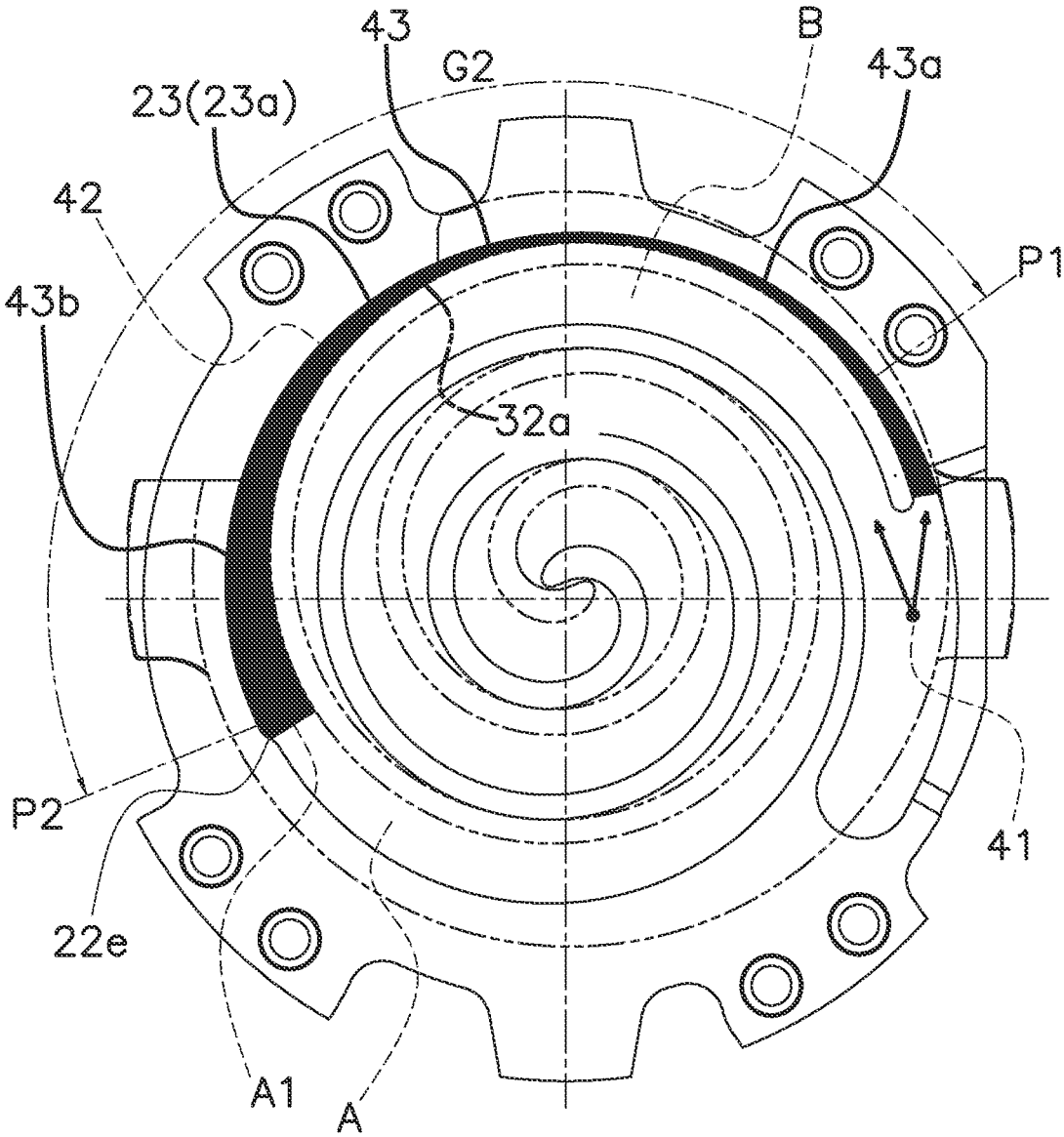
FIG. 5A is a plan view of a third passage 43 (illustrated in FIG. 4B) at a certain timing, the third passage 43 being filled with black for emphasis.
Figure 5B:
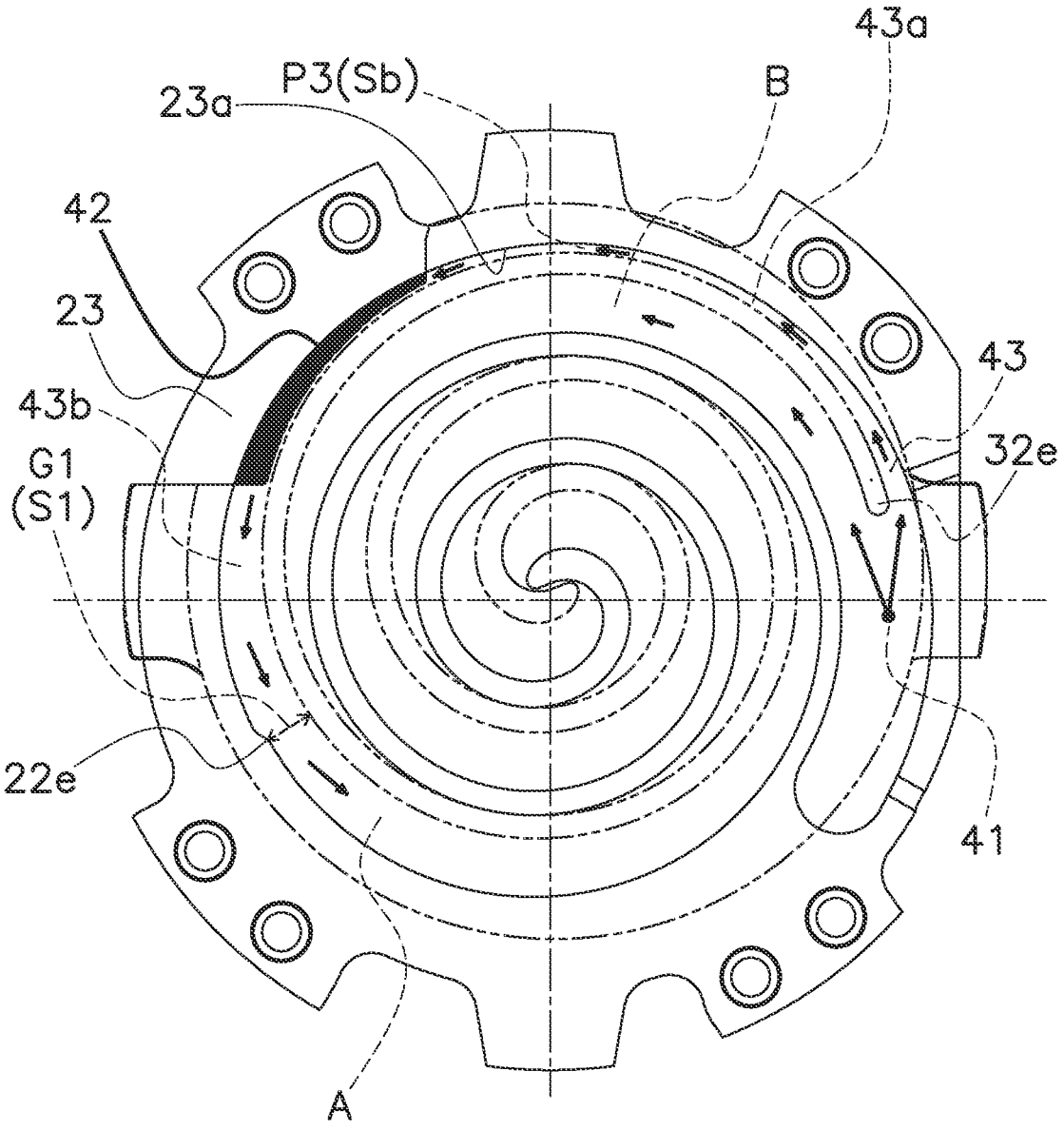
FIG. 5B is a plan view of a second passage 42 (illustrated in FIG. 4B) at a certain timing, the second passage 42 being filled with black for emphasis.
Figure 5C:
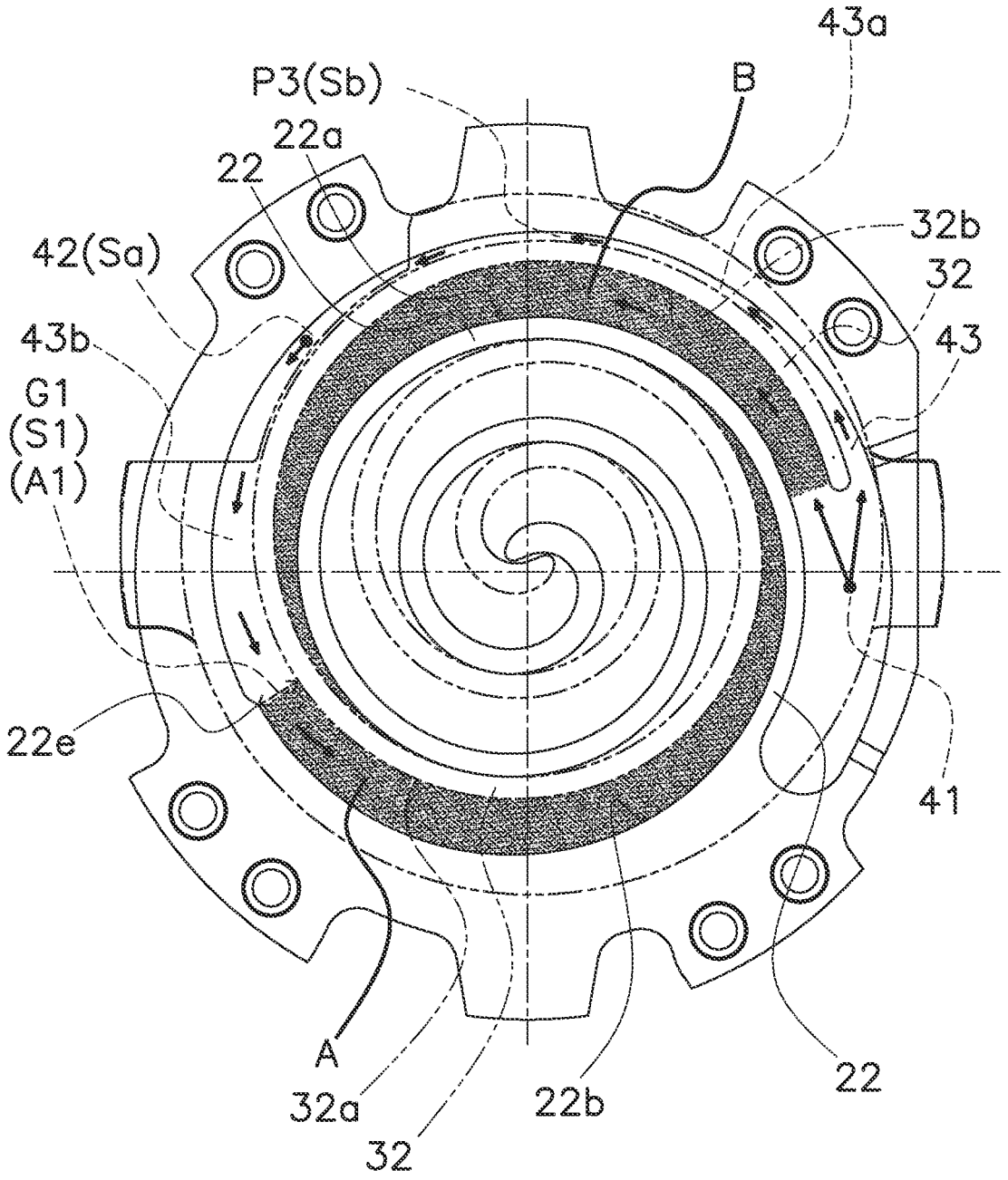
FIG. 5C is a plan view of each of the first and second compression chambers A and B (illustrated in FIG. 4B) at a certain timing, the first and second compression chambers A and B being hatched for emphasis.

As illustrated in FIGS. 4B and 5C, the first compression chamber A has an inlet A1 corresponding to a gap (a first gap G1) between the winding end portion 22*e* of the fixed-side wrap 22 and the outer peripheral face 32*a* of the movable-side wrap 32. The first gap G1 has an area that increases and decreases in accordance with swirling of the movable scroll 30.

(2-4-3-1) First Passage

The fixed scroll 20 has the above-mentioned first passage 41. The first passage 41 is a refrigerant flow path for guiding the gas refrigerant sucked externally, to the first compression chamber A and the second compression chamber B. The first passage 41 has a flow path area that does not change so much even in the state in which the fixed scroll 20 is combined with the movable scroll 30. The first passage 41 therefore guides a large amount of the gas refrigerant to a space around the winding end portion 32*e* of the movable-side wrap 32. In other words, the first passage 41 allows the refrigerant from the low-pressure space LPS to flow into the space around the winding end portion 32*e* of the movable-side wrap 32 with almost no resistance.

(2-4-3-2) Second Passage

The movable scroll 30 has the second passage 42. The second passage 42 is a flow path for guiding the gas refrigerant sucked into the low-pressure space LPS externally, to the first compression chamber A. As illustrated in FIGS. 4B and 5B, the second passage 42 corresponds to a region located inward of the inner face 23*a* of the wall 23 of the fixed scroll 20 and outward of an outer face of the cutout portion of the movable-side flat plate 31 of the movable scroll 30 in the state in which the movable scroll 30 is combined with the fixed scroll 20. In other words, the second passage 42 is equal in area to the region located inward of the inner face 23*a* of the wall 23 of the fixed scroll 20 and outward of the outer face of the cutout portion of the movable-side flat plate 31 of the movable scroll 30. If the movable-side flat plate 31 of the movable scroll 30 has no cutout portion, the second passage 42 is not provided. Since the movable-side flat plate 31 of the movable scroll 30 has the cutout portion corresponding to the second passage 42 located inside the virtual circle VC, the second passage 42 emerges in the state in which the movable scroll 30 is combined with the fixed scroll 20.

It should be noted that the second passage 42 in FIG. 5B is a passage that emerges when the position of the movable scroll 30 relative to the fixed scroll 20 is in a predetermined state. When the movable scroll 30 swirls, the shape and area of the passage in plan view change as illustrated in, for example, FIGS. 4C and 4D.

The gas refrigerant which has passed through the second passage 42 enters a third passage 43 to be described later, and merges with the gas refrigerant which has flowed through another passage. The merged gas refrigerant then flows into the first compression chamber A.

(2-4-3-3) Third Passage, Second Gap

As illustrated in FIGS. 4B and 5A, the third passage 43 is defined between the inlet A1 of the first compression chamber A and the first passage 41 in the fixed scroll 20. The third passage 43 is a flow path for guiding the gas refrigerant sucked into the low-pressure space LPS externally, to the first compression chamber A. As illustrated in, for example, FIGS. 4B, 5A, and 6B, the third passage 43 is surrounded with the front face 21*a* of the fixed-side flat plate 21, the front face 31*a* of the movable-side flat plate 31, the outer peripheral face 32*a*, which does not define the first and second compression chambers, of the movable-side wrap 32, and the inner face 23*a* of the wall 23 of the fixed scroll 20. The third passage 43 includes a downstream portion 43*b* and an upstream portion 43*a*. The downstream portion 43*b* is located near the inlet A1 of the first compression chamber A. The upstream portion 43*a* is located near the first passage 41 in the fixed scroll 20. The gas refrigerant which has passed through the first passage 41 flows into the first compression chamber A via the upstream portion 43*a* and downstream portion 43*b* of the third passage 43. The gas refrigerant which has passed through the second passage 42 flows into the first compression chamber A via the downstream portion 43*b* of the third passage 43.

In addition, the gas refrigerant flows into the third passage 43 via the second gap G2 defined in an angle range from P1 to P2 in FIG. 5A. As illustrated in FIG. 6B, the movable-side flat plate 31 is opposite an end face 23*b* of the wall 23 of the fixed scroll 20. A gap (i.e., the second gap G2) is defined between the movable-side flat plate 31 and the end face 23*b* of the wall 23 of the fixed scroll 20 in the direction of the rotation axis RA. The gas refrigerant is guided by the second gap G2 to the third passage 43 without passing through the first passage 41 and the second passage 42.

An inequality of $S1<Sa+Sb+Sc$ is established, where

S1 represents a sectional area of the first gap G1,

Sa represents a sectional area of the second passage 42 at a boundary between the second passage 42 and the third passage 43, Sb represents a sectional area of a portion P3 (see FIG. 5B) having a minimum passage area in the third passage 43, and Sc represents a sectional area of the second gap G2.

The second gap G2 extends to a position ahead of the inlet A1 of the first compression chamber A of the third passage 43; however, the second gap G2 does not extend to the region of the first compression chamber A as illustrated in FIG. 6A. This is because the second gap G2 in the region of the first compression chamber A hinders compression of the gas refrigerant.

(2-4-3-4) Planar Arrangement of First and Second Passages

The first passage 41 and the second passage 42 are separated from each other as seen in the direction of the rotation axis RA. As illustrated in FIG. 4B, the first passage 41 is closer to the winding end portion 32*e* of the movable-side wrap 32 than to the winding end portion 22*e* of the fixed-side wrap 22.

As illustrated in FIGS. 4B and 5B, the second passage 42 in the movable scroll 30 is closer to the winding end portion 22*e* of the fixed-side wrap 22 than to the winding end portion 32*e* of the movable-side wrap 32 as seen in the direction of the rotation axis RA.

As is clear from FIG. 3A, the second passage 42 in the movable scroll 30 is located inside the virtual circle VC (i.e., located near the center 32*c* of the movable-side wrap 32) as seen in the direction of the rotation axis RA. In the scroll compressor 10, therefore, the second passage 42 is separated from the cylindrical member 11*b* of the casing 11.

(3) Operation of Scroll Compressor

A description will be given of the operation of the scroll compressor 10.

When the motor 60 is driven, the rotor 62 rotates and the crank shaft 70 coupled to the rotor 62 also rotates. When the crank shaft 70 rotates, the movable scroll 30 does not rotate, but revolves with respect to the fixed scroll 20, by the action of the Oldham coupling. In the refrigeration cycle, when the low-pressure refrigerant flows into the low-pressure space LPS through the suction pipe, then the low-pressure refrigerant passes through the first passage 41, the second passage 42, the second gap G2, and the third passage 43. The low-pressure refrigerant then flows into the first and second compression chambers A and B on the peripheral edge side of the compression mechanism 12. The gas refrigerant which has passed through the third passage 43 via the first passage 41, the second passage 42, and the second gap G2 flows into the first compression chamber A through the inlet A1. The gas refrigerant which has passed through the first passage 41 located near the second compression chamber B as seen in plan view flows into the second compression chamber B.

As the movable scroll 30 revolves, the low-pressure space LPS does not communicate with the first and second compression chambers A and B in a stepwise manner (see the state illustrated in FIG. 4E). As the movable scroll 30 further revolves to reduce the volumes of the first and second compression chambers A and B, the pressures in the first and second compression chambers A and B rise. The pressure of the refrigerant gradually rises as the refrigerant moves from each of the first and second compression chambers A and B close to the peripheral edge of the compression mechanism 12, that is, located outward of the compression mechanism 12, to each of the first and second compression chambers A and B close to the center of the compression mechanism 12, that is, located inward of the compression mechanism 12. Finally, the high-pressure refrigerant is obtained in the refrigeration cycle. The refrigerant thus compressed is discharged from the compression mechanism 12 through the discharge port 21*b* in the fixed-side flat plate 21.

(4) Features (4-1)

When the scroll compressor that is disclosed in Patent Literature 1 (JP 2018-009537 A) sucks in the gas refrigerant, the gas refrigerant flows upward through the two refrigerant guide ports disposed opposite each other with the rotation in between. The gas refrigerant is then sucked into a compression mechanism. In the case where the refrigerant guide ports are disposed opposite each other with the rotation axis in between, a refrigerating machine oil supplied to a sliding portion such as a bearing curls upward due to the gas refrigerant flowing upward through the refrigerant guide ports. This structure encourages a phenomenon in which the refrigerating machine oil is taken out of the compressor (an oil loss phenomenon). It is preferable to suppress occurrence of this oil loss phenomenon as much as possible.

A scroll compressor 10 has a symmetric wrap structure and includes a fixed scroll 20, a movable scroll 30, and a crank shaft 70. The fixed scroll 20 includes a fixed-side flat plate 21 and a fixed-side wrap 22 having a spiral shape. The fixed-side wrap 22 extends downward from a front face 21*a* of the fixed-side flat plate 21. The movable scroll 30 includes a movable-side flat plate 31 and a movable-side wrap 32 having a spiral shape. The movable-side wrap 32 extends upward from a front face 31*a* of the movable-side flat plate 31. The crank shaft 70 is configured to rotate about a rotation axis RA and to drive the movable scroll 30. The fixed scroll 20 and the movable scroll 30 define a first compression chamber A surrounded with the front face 21*a* of the fixed-side flat plate 21, the front face 31*a* of the movable-side flat plate 31, an inner peripheral face 22*b* of the fixed-side wrap 22, and an outer peripheral face 32*a* of the movable-side wrap 32. The fixed scroll 20 and the movable scroll 30 define a second compression chamber B surrounded with the front face 21*a* of the fixed-side flat plate 21, the front face 31*a* of the movable-side flat plate 31, an outer peripheral face 22*a* of the fixed-side wrap 22, and an inner peripheral face 32*b* of the movable-side wrap 32. The fixed scroll 20 has a first passage 41. The first passage 41 is a refrigerant flow path for guiding a gas refrigerant sucked externally, to the first compression chamber A and the second compression chamber B. The movable scroll 30 has a second passage 42. The second passage 42 is a refrigerant flow path for guiding the gas refrigerant sucked externally, to the first compression chamber A. Each of the gas refrigerant which has passed through the first passage 41 and the gas refrigerant which has passed through the second passage 42 flows into the first compression chamber A. The gas refrigerant which has passed through the first passage 41 flows into the second compression chamber B.

In the scroll compressor 10, the gas refrigerant which has passed through the first passage 41 flows into the first compression chamber A and the second compression chamber B. The gas refrigerant which has passed through the second passage 42 flows into the first compression chamber A. The first passage 41 is provided in the fixed scroll 20. The second passage 42 is provided in the movable scroll 30. This configuration eliminates necessity to arrange the first passage 41 and the second passage 42 with the rotation axis RA interposed between the first passage 41 and the second passage 42. This configuration therefore improves the degree of freedom as to arrangement of the second passage 42. The second passage 42 is provided at the position illustrated in FIGS. 2A, 3A, and 5B. As illustrated in FIG. 5B, the size of the second passage 42 is determined such that the second passage 42 allows the gas refrigerant to pass therethrough so as to complement the first passage 41. The scroll compressor 10 therefore suppresses occurrence of a phenomenon in which the gas refrigerant flows upward at a high flow velocity on two sides (i.e., a side near the first passage 41 and its opposite side) of the low-pressure space LPS illustrated in FIG. 1. The scroll compressor 10 thus suppresses occurrence of an oil loss phenomenon.

(4-2)

In the scroll compressor 10, as illustrated in FIGS. 4B and 5B, the second passage 42 in the movable scroll 30 is closer to a winding end portion 22*e* of the fixed-side wrap 22 than to a winding end portion 32*e* of the movable-side wrap 32 as seen in the direction of the rotation axis RA.

Of the gas refrigerant that flows inward of the winding end portion 32*e* of the movable-side wrap 32 via the first passage 41 and the gas refrigerant that flows outward of the winding end portion 32*e* of the movable-side wrap 32 via the first passage 41, one flows into the second compression chamber B with almost no pressure loss, while the other flows into the first compression chamber A via the third passage 43. As illustrated in FIGS. 4B and 5A, the third passage 43 is long and has a narrow flow path area in places, which tends to result in shortage of the amount of the gas refrigerant flowing into the first compression chamber A. The second passage 42 for compensating for this shortage is located closer to the winding end portion 22*e* of the fixed-side wrap 22 than to the winding end portion 32*e* of the movable-side wrap 32. The scroll compressor 10 therefore reduces a difference between the amount of the gas refrigerant flowing into the first compression chamber A and the amount of the gas refrigerant flowing into the second compression chamber B.

It should be noted that the second passage 42 in FIG. 5B is a passage that emerges when the position of the movable scroll 30 relative to the fixed scroll 20 is in a predetermined state. When the movable scroll 30 swirls, the shape and area of the passage in plan view change as illustrated in, for example, FIGS. 4C and 4D. However, the second passage 42 for guiding the gas refrigerant in the low-pressure space LPS to the first compression chamber A is always closer to the winding end portion 22*e* of the fixed-side wrap 22 than to the winding end portion 32*e* of the movable-side wrap 32, irrespective of the position of the movable scroll 30 relative to the fixed scroll 20. In other words, the second passage 42 corresponds to a region located inward of an inner face 23*a* of a wall 23 of the fixed scroll 20 and outward of an outer face of a cutout portion of the movable-side flat plate 31 of the movable scroll 30 as seen in the direction of the rotation axis RA. In the second passage 42, a center of the flow path area as seen in the direction of the rotation axis RA (i.e., a center of gravity in sectional view) is always closer to the winding end portion 22*e* of the fixed-side wrap 22 than to the winding end portion 32*e* of the movable-side wrap 32.

(4-3)

As illustrated in FIG. 3A, in the movable scroll 30 of the scroll compressor 10, the movable-side flat plate 31 has an outer edge 31*b* that is substantially coincident with a virtual circle VC as seen in the direction of the rotation axis RA. The virtual circle VC is a circle in virtual plan view, and the outer edge 31*b* of the movable-side flat plate 31 is coincident with the virtual circle VC by 50% or more. The second passage 42 in the movable scroll 30 is located inside the virtual circle VC (i.e., located near a center 32*c* of the movable-side wrap 32) as seen in the direction of the rotation axis RA. In the scroll compressor 10, therefore, the second passage 42 is separated from a cylindrical member 11*b* of a casing 11. This configuration suppresses occurrence of a phenomenon in which the refrigerating machine oil flowing downward along an inner face of the cylindrical member 11*b* of the casing 11 curls upward due to the gas refrigerant flowing into the second passage 42.

(4-4)

As illustrated in FIGS. 2A and 2G, the first passage 41 in the fixed scroll 20 is a hole (an opening) bored in the fixed-side flat plate 21. Therefore, the first passage 41 is formed in the fixed scroll 20 with ease by casting or machining.

(4-5)

In the scroll compressor 10, the first compression chamber A has an inlet A1 corresponding to a gap (a first gap G1) between the winding end portion 22*e* of the fixed-side wrap 22 and the outer peripheral face 32*a* of the movable-side wrap 32. The first gap G1 has an area that increases and decreases in accordance with swirling of the movable scroll 30. The fixed scroll 20 and the movable scroll 30 define a third passage 43 between the inlet A1 of the first compression chamber A and the first passage 41 in the fixed scroll 20. The third passage 43 is a gas refrigerant flow path for guiding the gas refrigerant sucked externally, to the first compression chamber A. As illustrated in FIGS. 4B and 5A, the third passage 43 is surrounded with the front face 21*a* of the fixed-side flat plate 21, the front face 31*a* of the movable-side flat plate 31, the outer peripheral face 32*a*, which does not define the first and second compression chambers, of the movable-side wrap 32, and the inner face 23*a* of the wall 23 of the fixed scroll 20. The third passage 43 includes a downstream portion 43*b* and an upstream portion 43*a*. The downstream portion 43*b* is located near the inlet A1 of the first compression chamber A. The upstream portion 43*a* is located near the first passage 41 in the fixed scroll 20. The gas refrigerant which has passed through the first passage 41 flows into the first compression chamber A via the upstream portion 43*a* and downstream portion 43*b* of the third passage 43. The gas refrigerant which has passed through the second passage 42 flows into the first compression chamber A via the downstream portion 43*b* of the third passage 43.

In the scroll compressor 10, the third passage 43 allows a part of the gas refrigerant which has passed through the first passage 41 in the fixed scroll 20 to be guided to the first compression chamber A rather than the second compression chamber B. Even in such a scroll compressor 10 that a second passage 42 is smaller than a first passage 41 and a small amount of gas refrigerant flows into the second passage 42, this configuration reduces a difference between an amount of the gas refrigerant flowing into the first compression chamber A and an amount of the gas refrigerant flowing into the second compression chamber B.

(4-6)

In the scroll compressor 10, as illustrated in FIG. 6B, the movable-side flat plate 31 and an end face 23*b* of the wall 23 of the fixed scroll 20 are disposed opposite each other with a gap (a second gap G2) interposed between the movable-side flat plate 31 and the end face 23*b* of the wall 23 of the fixed scroll 20 in the direction of the rotation axis RA. The gas refrigerant is guided by the second gap G2 to the third passage 43 without passing through the first passage 41 and the second passage 42.

An inequality of $S1<Sa+Sb+Sc$ is established, where

S1 represents a sectional area of the first gap G1,

Sa represents a sectional area of the second passage 42 at a boundary between the second passage 42 and the third passage 43, Sb represents a sectional area of a portion P3 (see FIG. 5B) having a minimum passage area in the third passage 43, and Sc represents a sectional area of the second gap G2.

In the scroll compressor 10, the sectional areas Sa, Sb, and Sc of the flow paths via which the gas refrigerant flows into the first compression chamber A are determined such that the inequality described above is established. This configuration therefore secures an amount of the gas refrigerant flowing into the first compression chamber A. As a result, this configuration enables a considerable reduction of the difference between the amount of the gas refrigerant flowing into the first compression chamber A and the amount of the gas refrigerant flowing into the second compression chamber B.

(4-7)

In the scroll compressor 10, the first passage 41 and the second passage 42 are separated from each other as seen in the direction of the rotation axis RA. The first passage 41 is closer to the winding end portion 32*e* of the movable-side wrap 32 than to the winding end portion 22*e* of the fixed-side wrap 22.

In other words, in the scroll compressor 10, the first passage 41 is located near the winding end portion 32*e* of the movable-side wrap 32. This configuration therefore reduces a pressure loss of the gas refrigerant flowing into the second compression chamber B via the first passage 41. On the other hand, each of the gas refrigerant which has passed through the first passage 41 and the gas refrigerant which has passed through the second passage 42 flows into the first compression chamber A. This configuration therefore secures the amount of the gas refrigerant flowing into the first compression chamber A even when the pressure loss of the gas refrigerant increases.

(5) Modifications (5-1)

In the foregoing embodiment, the first passage 41 in the fixed scroll 20 is a hole as illustrated in FIGS. 2A and 2G. Alternatively, the first passage 41 may be a cutout rather than a hole.

In the foregoing embodiment, the movable-side flat plate 31 of the movable scroll 30 has the cutout serving as the second passage 42, as illustrated in FIG. 3A. Alternatively, the movable-side flat plate 31 of the movable scroll 30 may have an elongated opening rather than a cutout.

(5-2)

While various embodiments of a scroll compressor have been described herein above, it is to be appreciated that various changes in form and detail may be made without departing from the spirit and scope of the present disclosure presently or hereafter claimed.

The invention claimed is:

1. A scroll compressor having a symmetric wrap structure and being fully hermetic, the scroll compressor comprising:

a fixed scroll including a fixed-side flat plate and a fixed-side wrap having a spiral shape and extending from a front face of the fixed-side flat plate;

a movable scroll including a movable-side flat plate and a movable-side wrap having a spiral shape and extending from a front face of the movable-side flat plate;

a crank shaft configured to rotate about a rotation axis to drive the movable scroll;

a motor configured to rotate the crank shaft; and a casing having an internal space defined to accommodate the fixed scroll, the movable scroll, the crank shaft, and the motor, the casing including an oil reservoir configured to retain a refrigerating machine oil, the oil reservoir being located on a bottom of the internal space, and a motor space configured to accommodate the motor, the motor space serving as a low-pressure space into which a low-pressure gas refrigerant is sucked externally, the fixed scroll and the movable scroll defining a first compression chamber surrounded by the front face of the fixed-side flat plate, the front face of the movable-side flat plate, an inner peripheral face of the fixed-side wrap, and an outer peripheral face of the movable-side wrap, the fixed scroll and the movable scroll defining a second compression chamber surrounded by the front face of the fixed-side flat plate, the front face of the movable-side flat plate, an outer peripheral face of the fixed-side wrap, and an inner peripheral face of the movable-side wrap, the fixed scroll and the movable scroll being disposed in an upper part of the internal space in the casing, the fixed scroll having a first passage configured to guide the gas refrigerant in the low-pressure space to the first compression chamber and the second compression chamber, the movable scroll having a second passage configured to guide the gas refrigerant in the low-pressure space to the first compression chamber, the gas refrigerant that has passed through the first passage and the gas refrigerant that has passed through the second passage flows into the first compression chamber, and the gas refrigerant that has passed through the first passage also flows into the second compression chamber.

2. The scroll compressor according to claim 1, wherein the fixed-side wrap and the movable-side wrap extend in a direction of the rotation axis, the inner peripheral face of the fixed-side wrap continuously extends from a winding start portion of the fixed-side wrap, the winding start portion being closer to a center of the fixed-side wrap, to a winding end portion of the fixed-side wrap, the winding end portion being farther from the center of the fixed-side wrap, the outer peripheral face of the movable-side wrap continuously extends from a winding start portion of the movable-side wrap, the winding start portion being closer to a center of the movable-side wrap, to a winding end portion of the movable-side wrap, the winding end portion being farther from the center of the movable-side wrap, and the second passage in the movable scroll is closer to the winding end portion of the fixed-side wrap than to the winding end portion of the movable-side wrap as seen along the direction of the rotation axis.

3. The scroll compressor according to claim 2, wherein the fixed-side wrap and the movable-side wrap extend in a direction of the rotation axis, the movable-side flat plate has an outer edge that is coincident with a virtual circle for 50% or more thereof as seen along the direction of the rotation axis, and the second passage in the movable scroll is located inside the virtual circle as seen along the direction of the rotation axis.

4. The scroll compressor according to claim 3, wherein the first passage in the fixed scroll includes a hole or a cutout.

5. The scroll compressor according to claim 2, wherein the first compression chamber has an inlet corresponding to a first gap between the winding end portion of the fixed-side wrap and the outer peripheral face of the movable-side wrap, the first gap has an area that increases and decreases in accordance with swirling of the movable scroll, the fixed scroll further includes a wall that does not define the first and second compression chambers, the fixed scroll and the movable scroll define a third passage configured to guide the gas refrigerant sucked externally to the first compression chamber, the third passage being located between the inlet of the first compression chamber and the first passage in the fixed scroll, the third passage is surrounded by the front face of the fixed-side flat plate, the front face of the movable-side flat plate, the outer peripheral face, which does not define the first and second compression chambers, of the movable-side wrap, and an inner face of the wall of the fixed scroll, the third passage includes a downstream portion located near the inlet of the first compression chamber, and an upstream portion located near the first passage in the fixed scroll, the gas refrigerant that has passed through the first passage flows into the first compression chamber via the upstream portion and downstream portion of the third passage, and the gas refrigerant that has passed through the second passage flows into the first compression chamber via the downstream portion of the third passage.

6. The scroll compressor according to claim 5, wherein the movable-side flat plate and the end face of the wall of the fixed scroll are disposed opposite each other with a second gap interposed therebetween in the direction of the rotation axis, the gas refrigerant is guided by the second gap to the third passage without passing through the first passage and the second passage, and $S1<Sa+Sb+Sc$, in which S1 is a sectional area of the first gap, Sa is a sectional area of the second passage at a boundary between the second passage and the third passage, Sb is a sectional area of a portion having a minimum passage area in the third passage, and Sc is a sectional area of the second gap.

7. The scroll compressor according to claim 2, wherein the first passage and the second passage are separated from each other as seen along the direction of the rotation axis, and the first passage is closer to the winding end portion of the movable-side wrap than to the winding end portion of the fixed-side wrap.

8. The scroll compressor according to claim 2, wherein the first passage in the fixed scroll includes a hole or a cutout.

9. The scroll compressor according to claim 1, wherein the fixed-side wrap and the movable-side wrap extend in a direction of the rotation axis, the movable-side flat plate has an outer edge that is coincident with a virtual circle for 50% or more thereof as seen along the direction of the rotation axis, and the second passage in the movable scroll is located inside the virtual circle as seen along the direction of the rotation axis.

10. The scroll compressor according to claim 9, wherein the first passage in the fixed scroll includes a hole or a cutout.

11. The scroll compressor according to claim 1, wherein the first passage in the fixed scroll includes a hole or a cutout.

* * * * *